US007733313B2

(12) United States Patent
Hwang

(10) Patent No.: US 7,733,313 B2
(45) Date of Patent: Jun. 8, 2010

(54) PICTURE QUALITY CONTROLLING SYSTEM

(75) Inventor: Jong Hee Hwang, Osang-si (KR)

(73) Assignee: LG. Display Co., Ltd., Seoul (KR)

( * ) Notice: Subject to any disclaimer, the term of this patent is extended or adjusted under 35 U.S.C. 154(b) by 732 days.

(21) Appl. No.: 11/634,544

(22) Filed: Dec. 6, 2006

(65) Prior Publication Data

US 2007/0182441 A1 Aug. 9, 2007

(30) Foreign Application Priority Data

Feb. 6, 2006 (KR) ..... 10-2006-0011237

(51) Int. Cl.
*G09G 3/36* (2006.01)

(52) U.S. Cl. ..... 345/88; 345/690; 345/214

(58) Field of Classification Search ..... 345/87–100, 345/204, 214, 690, 698; 348/180–194, 658, 348/745, 246–280; 349/54, 192
See application file for complete search history.

(56) References Cited

U.S. PATENT DOCUMENTS 5,793,344 A * 8/1998 Koyama ..... 345/87
2006/0066547 A1* 3/2006 Nitta et al. ..... 345/88

FOREIGN PATENT DOCUMENTS

CN 1352447 6/2002
JP 2002-366109 12/2002

OTHER PUBLICATIONS

Office Action issued in corresponding Chinese Patent Application No. 2006101682018; issued Aug. 1, 2008.

* cited by examiner

*Primary Examiner*—Regina Liang
(74) *Attorney, Agent, or Firm*—Brinks Hofer Gilson & Lione

(57) ABSTRACT

A picture quality control system can determine a location of a display panel defect. The system can calculate data used to compensate for the display defect and modulate the compensation data on a video signal to compensate for the defect. The defect may be associated with a pixel or with a display panel area. A picture quality system may include a memory and a compensation circuit. The memory may store compensation data that represents a panel defect location and/or a charge characteristic. The compensation circuit may process the compensation data to increase or decrease brightness information and/or component information of a video signal.

16 Claims, 30 Drawing Sheets

PICTURE QUALITY CONTROLLING SYSTEM

BACKGROUND OF THE INVENTION

1. Priority Claim

This application claims the benefit of priority from Korean Patent Application No. P06-0011237 filed on Feb. 6, 2006 which is hereby incorporated by reference.

2. Technical Field

The present invention relates to a display device, and more particularly to a flat panel display device that is adaptive for improving picture quality by data modulation.

3. Related Art

Various flat panel display devices may have a reduced weight and size as compared to a display with a cathode ray tube. The flat panel display device may include various display panels such as a liquid crystal display, field emission display, plasma display panel, organic light emitting diode, and the like.

In some display devices, a picture quality defect can be identified when testing the display panel. The picture quality defect may include a panel defect (or mura defect), a bright spot caused by a defective pixel, a bright line caused by a backlight, and/or other visual imperfections.

A panel defect may cause a display spot which is seen to have a different brightness from an ambient screen. The display spot can have a shape of a dot, a belt, a block, a circle, a polygon, and/or other determined or undetermined forms. In some instances, a panel defect can occur because of a process defect and/or a lens number difference of an exposure machine. In some instances of a panel defect, when the same signal is applied to a defective panel area and a non-defective panel area, a picture displayed in the defective panel area is displayed darker or brighter than the picture displayed in the non-defective. In other instances, the color impression in the defective panel area and non-defective panel area can appear to be different. Panel defects may be generated in a fabrication process. Examples of panel defects having such various forms are shown in FIGS. 1A to 1E. A panel defect of a vertical belt is shown in FIGS. 1A to 1C and can be generated because of overlapping exposure and/or a difference in the number of lenses. A panel defect of a dot shape and an irregular shape are shown in FIGS. 1D and 1E, and may be generated by impurities. Due to the panel defect, Products may be condemned in accordance with the defect level, the defect of such products drops yield, and this leads to the increase of cost. Further, even when a product is found to have a panel defect but is shipped as a non-defective product, the picture quality can deteriorated due to the panel defect and the reliability of the product can decrease. Various methods have been proposed in order to improve the panel defects. However, these methods mainly address solving problems in the fabrication process.

A defective pixel on a display panel can be generated by a short circuit and/or wire breakage of a signal line, a defect of a thin film transistor ("TFT"), and/or an electrode pattern defect. The picture quality defect caused by a defective pixel can appear as a dark spot or bright spot in the display screen. Because the bright spot has a relatively greater degree of perception felt by the bare eyes as compared to a dark spot, the defective pixel appearing as the bright spot can be made darker so as to overcome the picture quality defect. Although a defective pixel made to be the dark spot, as shown in FIG. 2A, is almost not perceived in the display screen of the black gray level, the display screen of the middle gray level and white gray level, as shown in FIGS. 2B and 2C, there is a problem that the defective sub-pixel 10 made to be the dark spot is clearly perceived as a dark spot in the display picture even though the degree of perception felt by the bare eyes is low in comparison with the bright spot.

The bright line caused by the backlight the picture quality defect which can appear in the liquid crystal display device among various flat panel display devices. The liquid crystal display device, which is not a display device using a self luminous device, irradiates light to a rear surface of the display panel with a backlight, and controls the transmittance of light from the rear surface to the front surface so as to display a picture. The liquid crystal display device has a problem that the bright line appears on the display screen because the light from the backlight is not evenly incident to the whole incidence surface of the display panel. FIG. 3 represents an example of the bright line which mainly appears in the liquid crystal display device using a direct type backlight.

SUMMARY

A picture quality control system can determine a location of a display panel defect. The system can calculate data used to compensate for the display defect and modulate the compensation data on a video signal to compensate for the defect. The defect may be associated with a pixel or with a display panel area.

A picture quality system may include a memory and a compensation circuit. The memory may store compensation data that represents a panel defect location and/or a charge characteristic. The compensation circuit may process the compensation data to increase or decrease brightness information and/or component information of a video signal.

Other systems, methods, features and advantages will be or will become apparent to one with skill in the art upon examination of the following figures and detailed description. It is intended that all such additional systems, methods, features and advantages be include within this description, be within the scope of the invention, and be protected by the following claims.

BRIEF DESCRIPTION OF THE DRAWINGS

The system may be better understood with refernce to the following drawings and description. The components in the figures are not necessarily to scale, emphasis instead being placed upon illustrating the principles of the invention. Moreover, in the figures, liked referenced numerals designate corresponding parts throughout different views.

DETAILED DESCRIPTION OF THE PREFERRED EMBODIMENTS

Figure 1A:
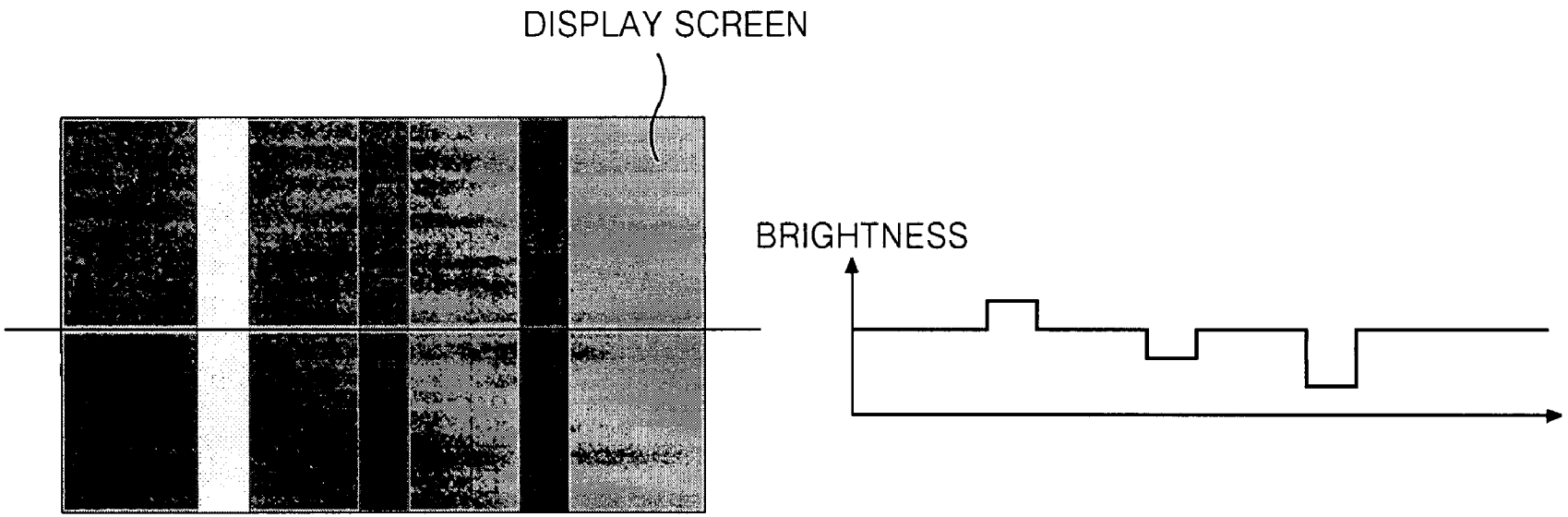
FIG.1A RELATED ART
FIGS. 1A to 1E show various shapes of panel defects.
Figure 1B:
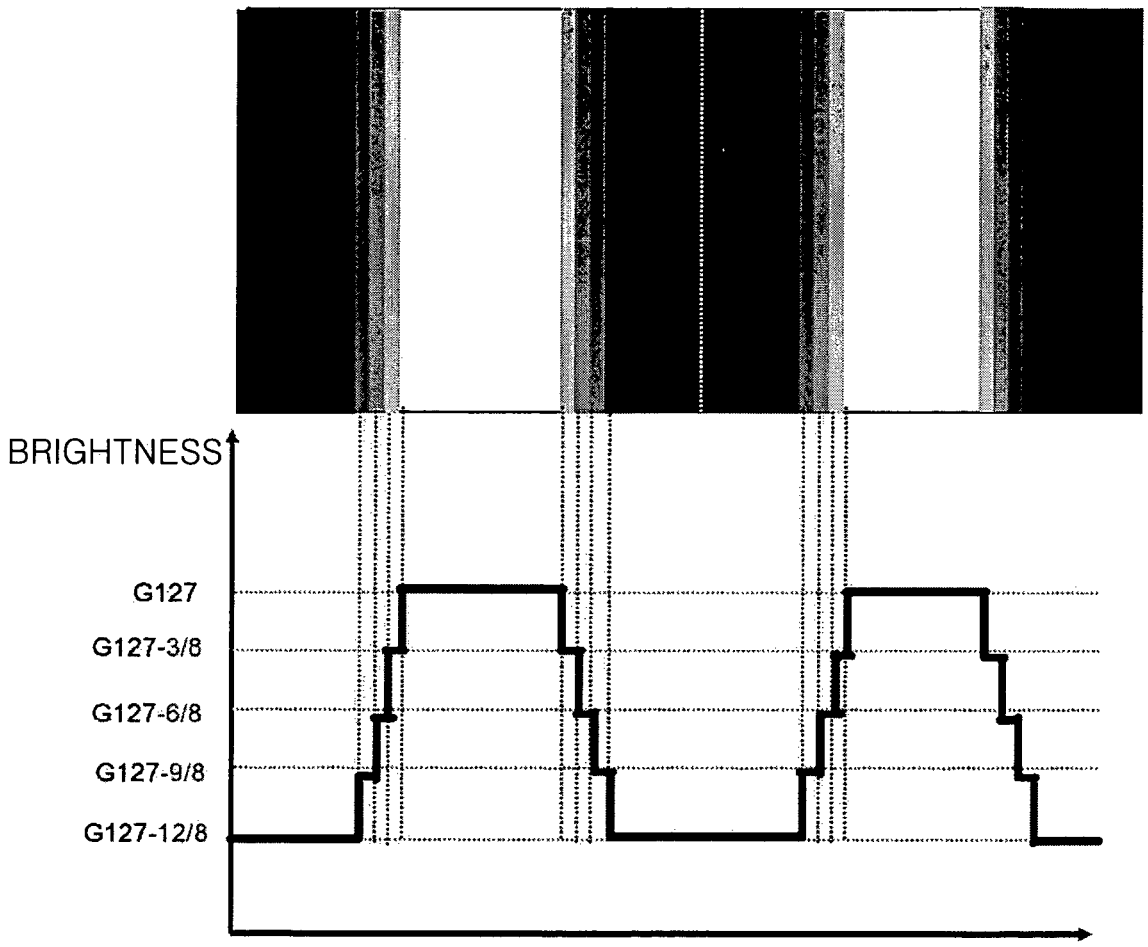
FIG.1B RELATED ART
Figure 1C:
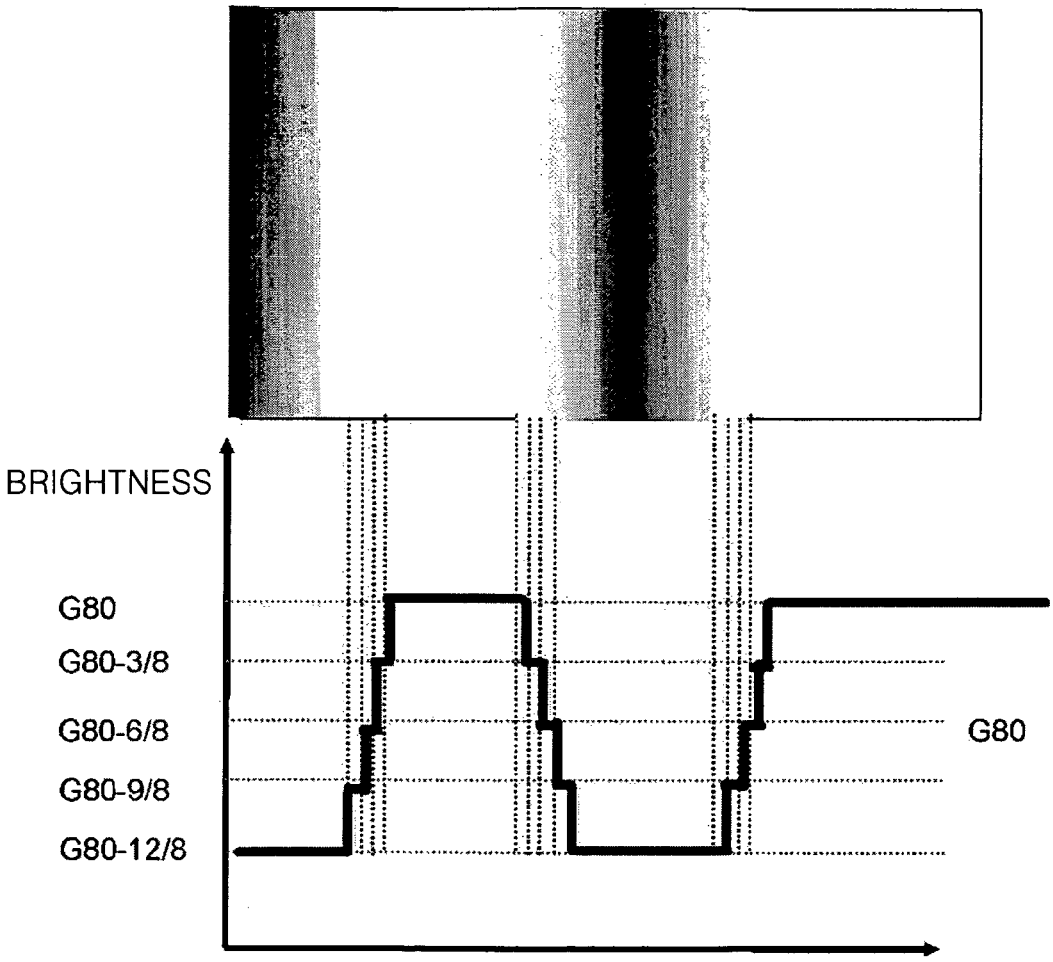
FIG. 1C RELATED ART
Figure 1D:
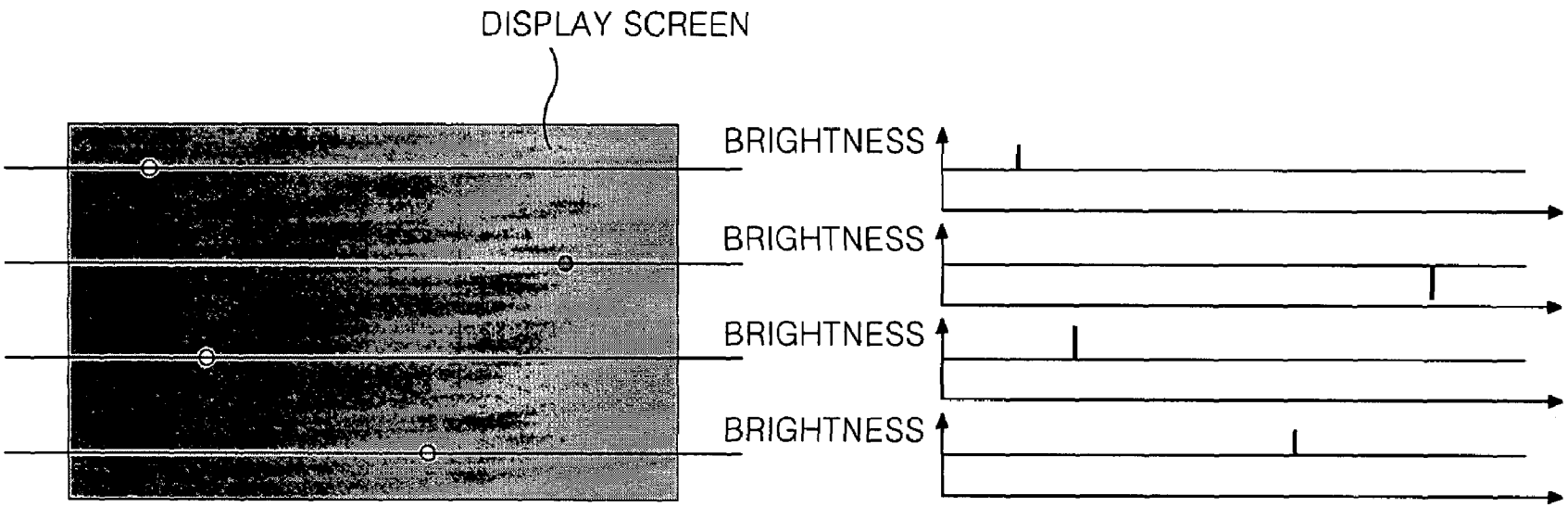
FIG.1D RELATED ART
Figure 1E:
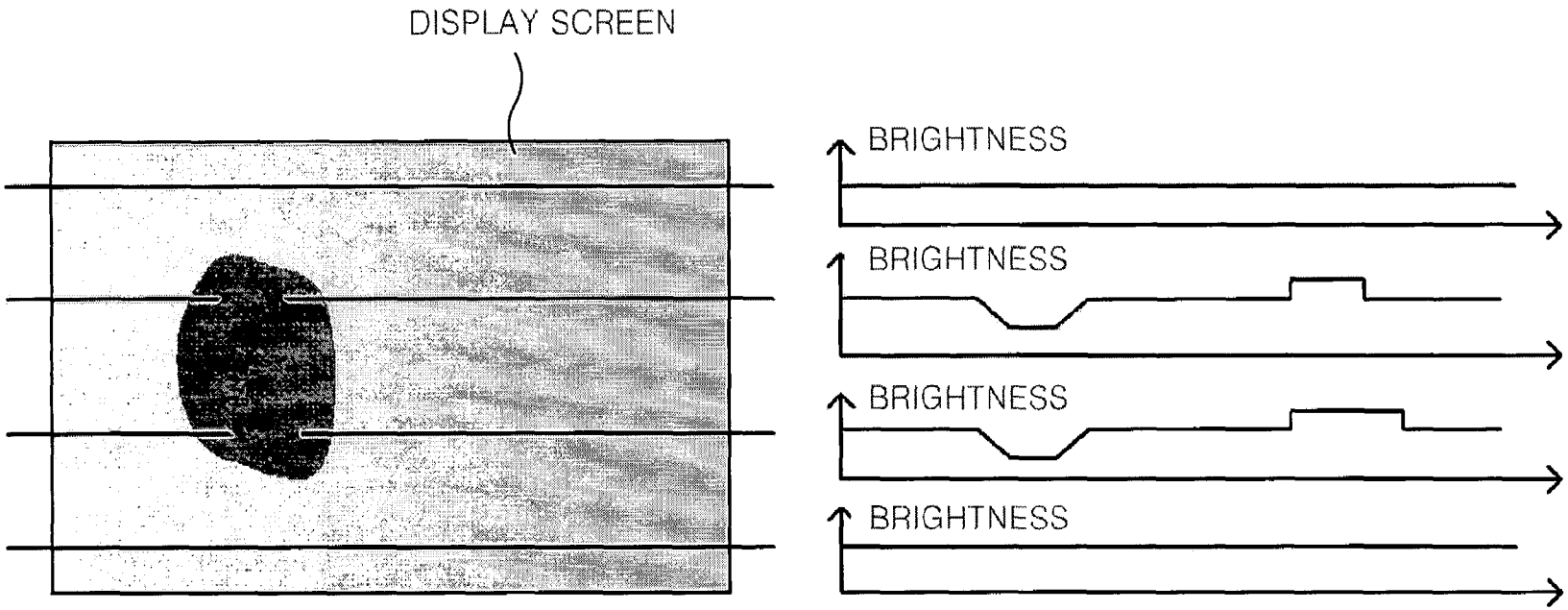
FIG. 1E RELATED ART
Figure 2A:
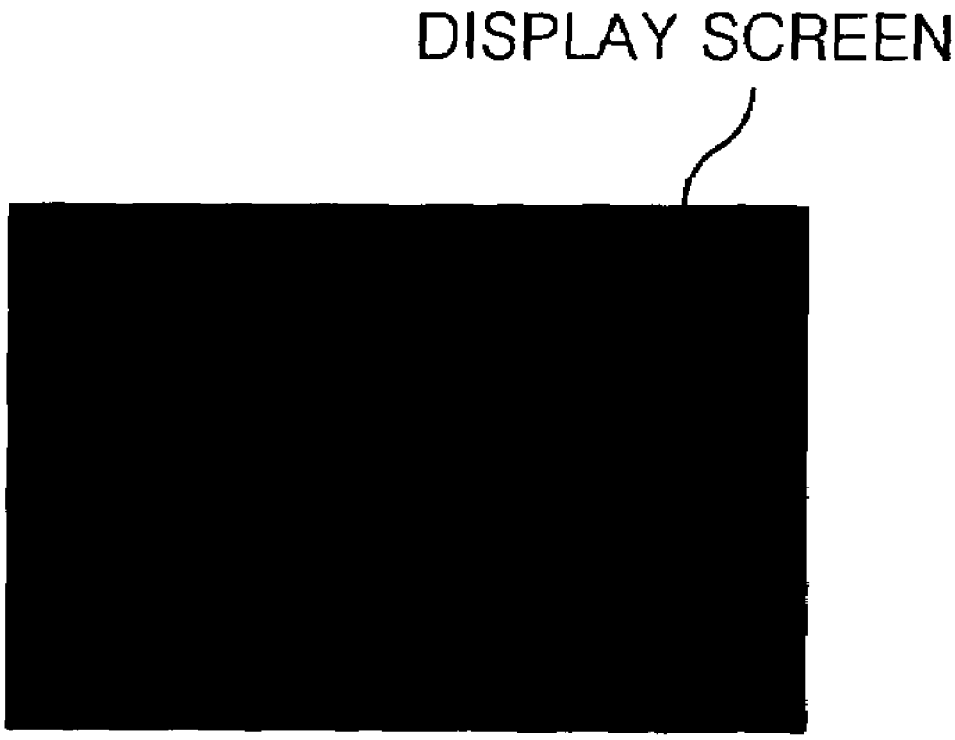
FIG.2A RELATED ART
FIGS. 2A to 2C show various gray levels when a defect pixel is made to be a dark spot.
Figure 2B:
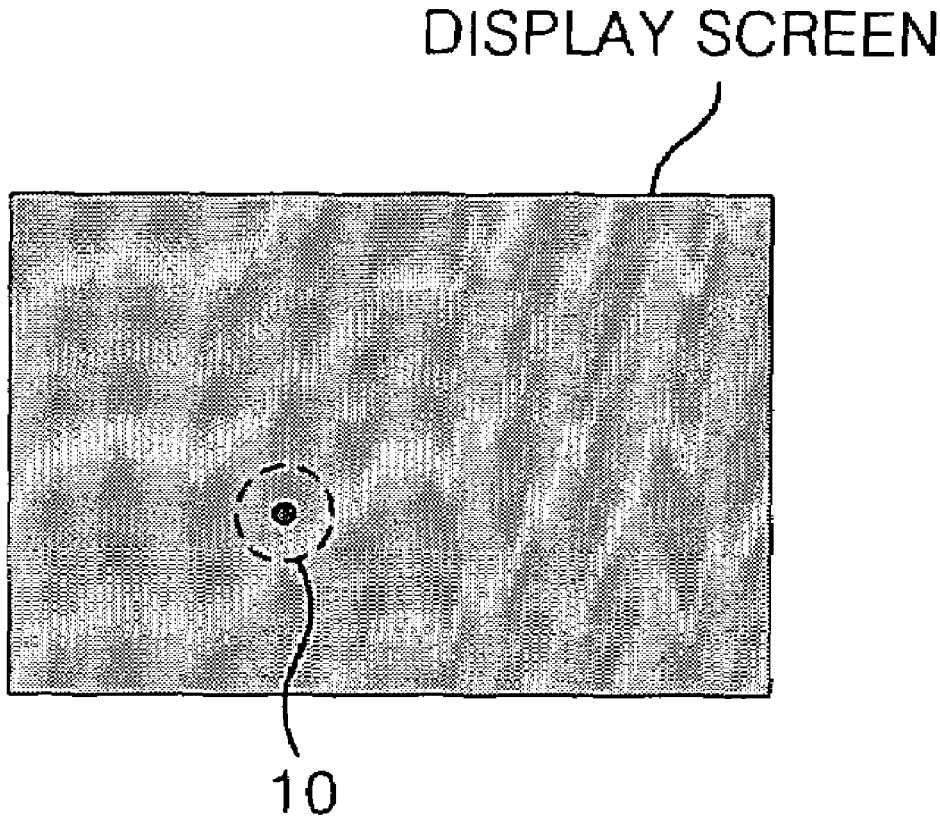
FIG.2B RELATED ART
Figure 2C:
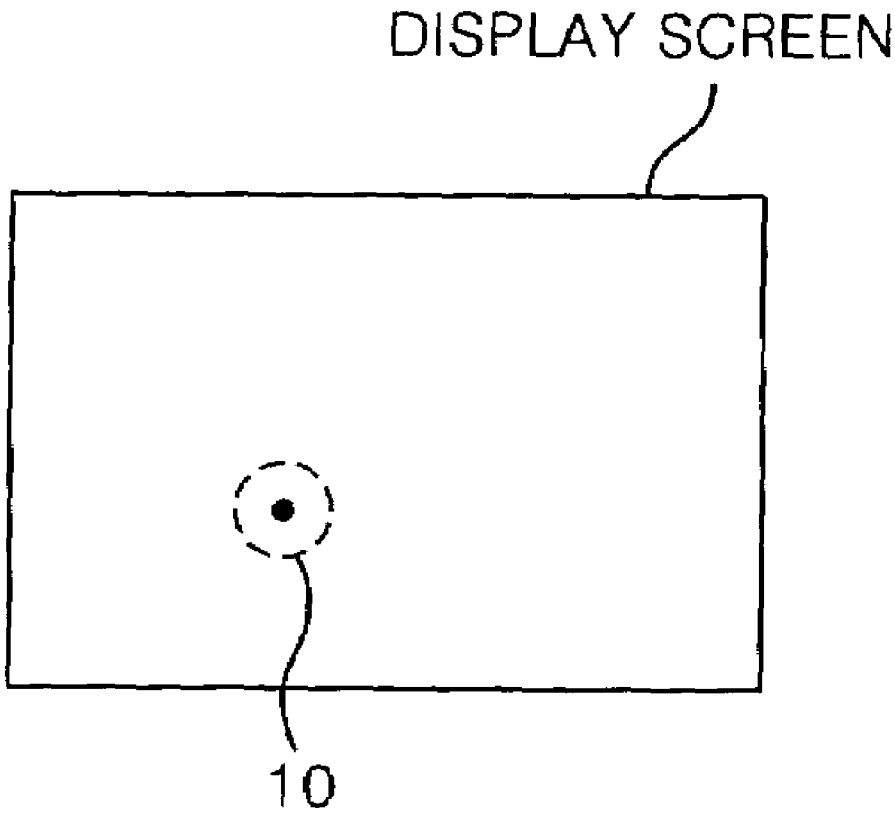
FIG.2C RELATED ART
Figure 3:
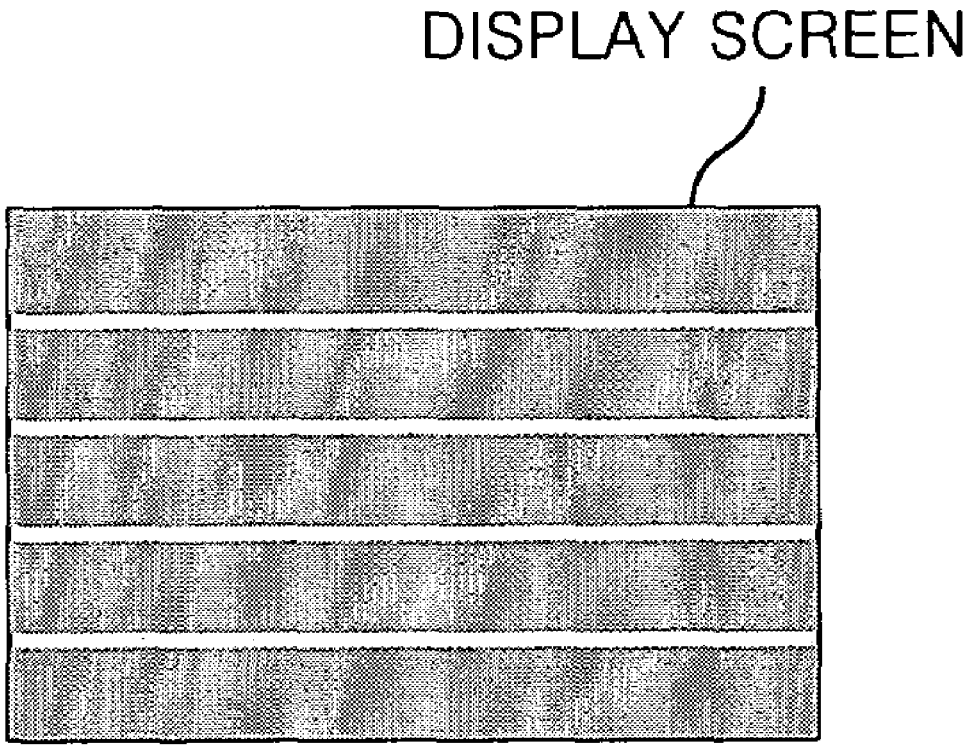
FIG. 3 RELATED ART
FIG. 3 is a diagram representing a picture quality defect by a bright line caused by a backlight.
Figure 4:
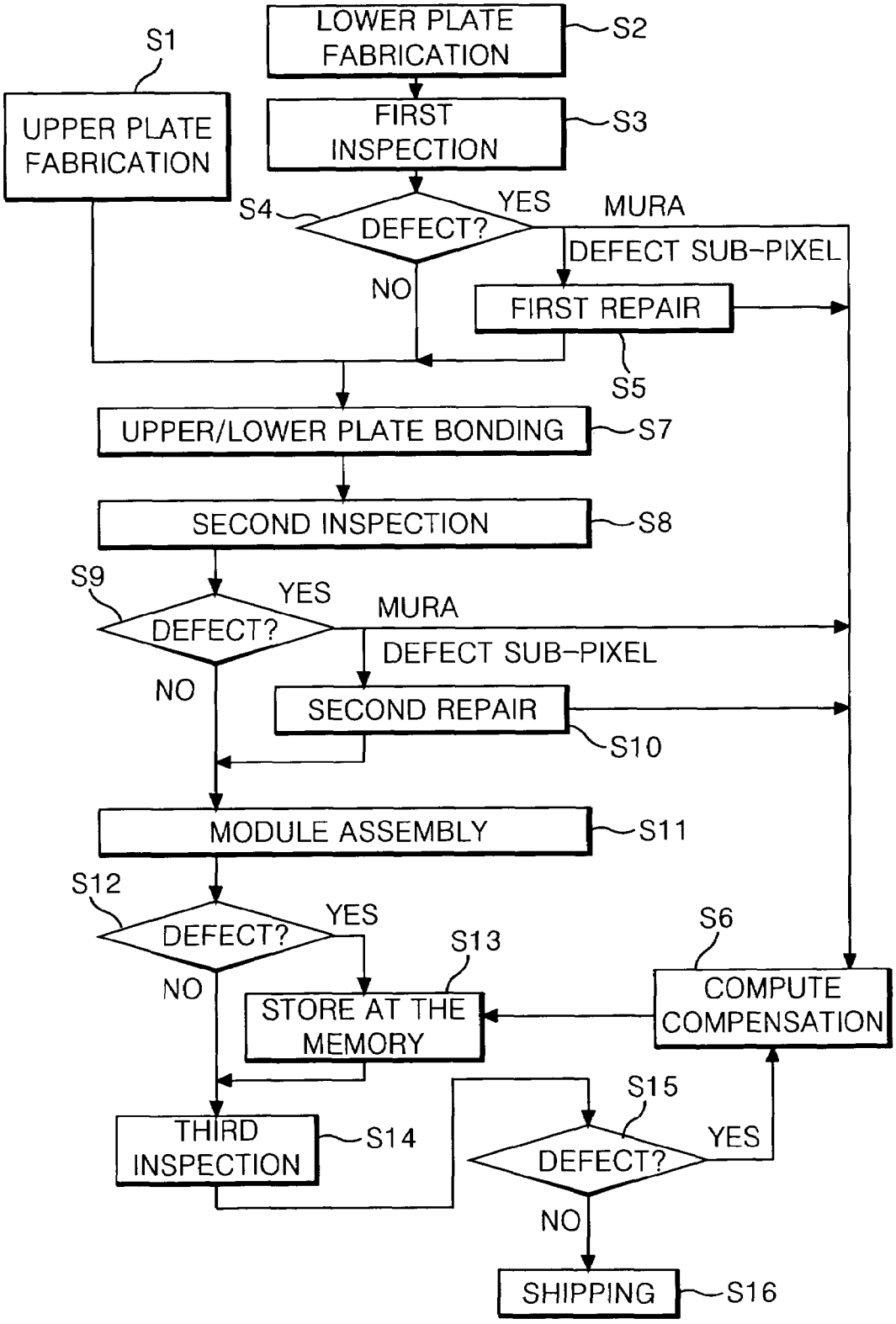
FIG. 4 is flowchart of a fabrication method of a flat panel display device.
Figure 5:
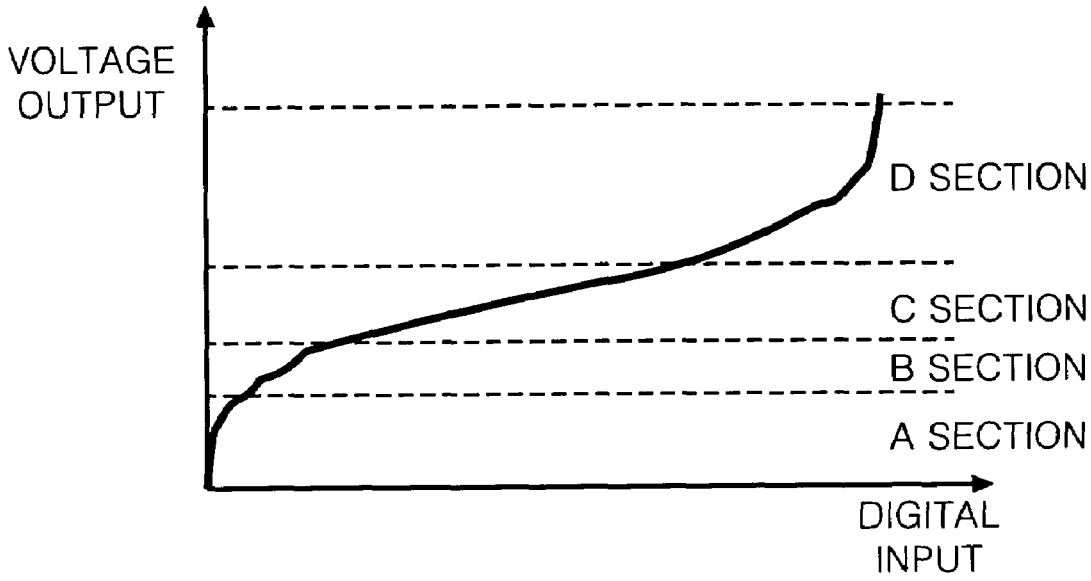
FIG. 5 is a diagram for briefly explaining a link sub-pixel according to an embodiment of the present invention.

FIG. 4 is a fabricating method of a liquid crystal display device. An upper substrate (color filter substrate) and a lower substrate (TFT array substrate) of a display panel are separately formed at steps S1 and S2, respectively. The steps of S1 and S2 may include a substrate cleaning process, a substrate patterning process, and/or an alignment film forming/rubbing process. In the substrate cleaning process, impurities on the surfaces of the upper and lower substrates can be removed with a cleaning solution. The substrate patterning process can be divided into an upper substrate patterning process and a lower substrate patterning process. In the upper substrate patterning process, a color filter, a common electrode, and/or a black matrix can be formed. In the lower substrate patterning process, signal lines such as a data line and a gate line are formed. A TFT is formed at the crossing part of the data line and the gate line, and a pixel electrode is formed at a pixel area provided by the crossing of the data line and the gate line. Alternatively, the lower substrate patterning process, as shown in FIG. 5, might include the process of patterning a conductive link pattern 12 for linking a normal sub-pixel 11 and a defect sub-pixel 10.

In step S3, the lower substrate of the display panel is inspected for a defect(s). The inspection may include applying gray level test data to the lower substrate of the display panel and displaying a test picture. A presence of a panel defect and/or a defective sub-pixel may be detected by an electrical/magnetic inspection and/or a bare eye inspection of the picture. The sub-pixel can be any one of red R, green G and blue B sub-pixels which compose one pixel. Since the pixel defect appears by the unit of a sub-pixel, second and third inspection processes S8 and S14, and first and second repair processes S5 and S10 can be made on the sub-pixel unit level.

In the event that a panel defect is detected at step S3, the presence of the panel defect and/or information of the defect's location may be stored at an inspection computer. At step S6, the inspection computer can compute panel defect compensation data for each gray level for each location of the panel defect.

Figure 6:
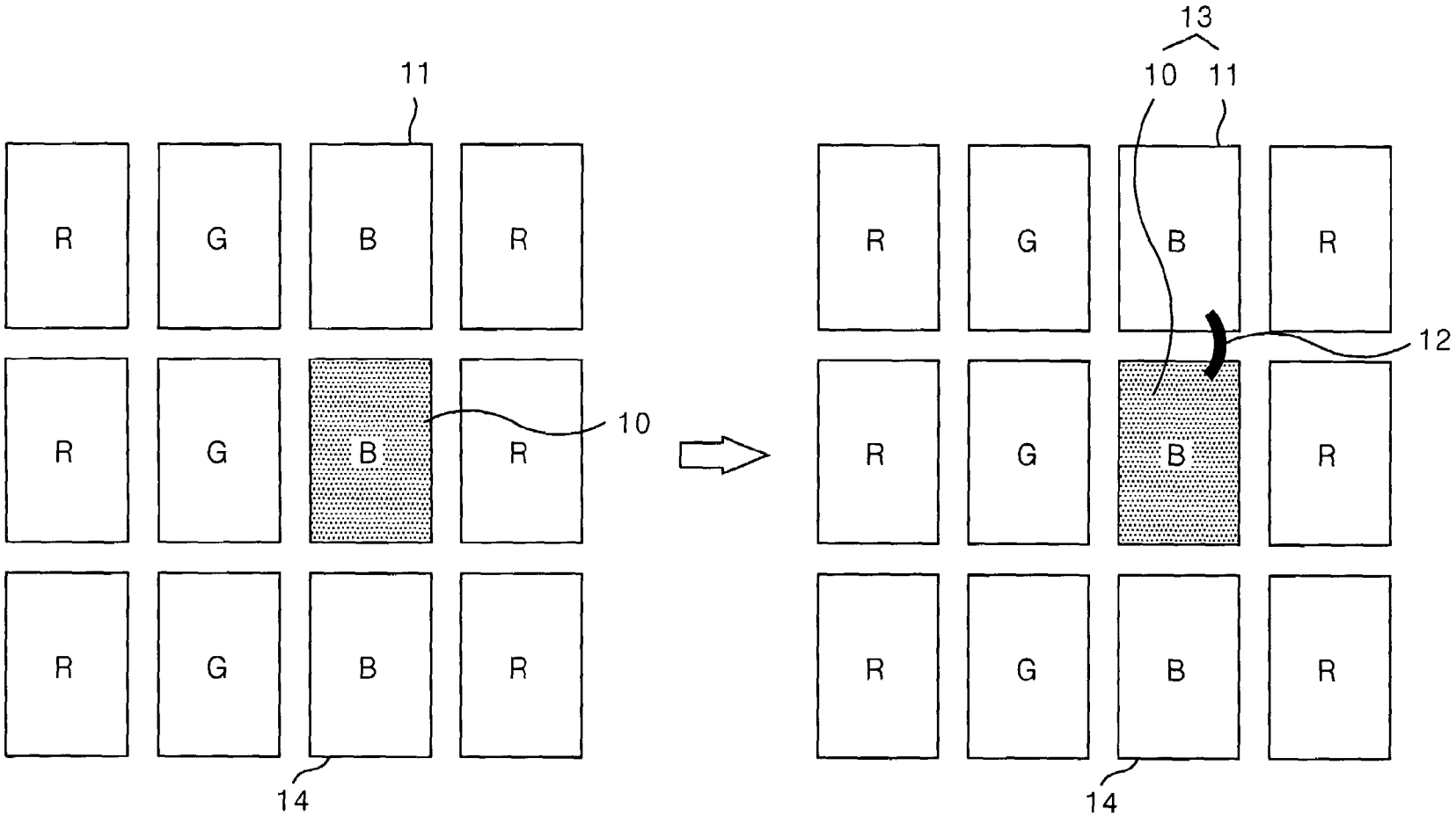
FIG. 6 is a diagram representing a gamma characteristic.

A first repair process of step S5 is shown in FIG. 6. The first repair process may be performed by electrically shorting or linking a defective sub-pixel 10 with an adjacent normal ("non-defective") sub-pixel 11 of the same color as the defective sub-pixel 10. The first repair process S5 can include a process of cutting-off a path through which a data voltage is supplied to a pixel electrode of a defective sub-pixel 10 and a process of electrically shorting or linking the normal sub-pixel 11 and the defective sub-pixel 10 by use of the conductive link pattern 12. Depending on the conductive link pattern 12 that is employed, the first repair process may be performed according to various different methods.

In FIG. 6, a linked defective sub-pixel 13 is formed by linking a defective sub-pixel 10 and non-defective sub-pixel 11. The linked defective sub-pixel 13 can be charged with the same data voltage when charging the non-defective sub-pixel 11 with a data voltage in a linked sub-pixel 13 where a non-defective sub-pixel 11 and a defective sub-pixel 10 of the same color are electrically connected. But, the linked sub-pixel 13 has a different charge characteristic in comparison with a non-defective sub-pixel 14 which is not linked because electric charges are supplied to the pixel electrodes included in two sub-pixels 10, 11 through one TFT. For example, when the same data voltage is supplied to the linked sub-pixel 13 and the not-linked non-defective sub-pixel 14, the linked sub-pixel 13 has the electric charges dispersed to the two sub-pixels 10, 11, thus the amount of charged electric charge is little in comparison with the not-linked non-defective sub-pixel 14. As a result, when the same data voltage is supplied to the not-linked non-defective sub-pixel 14 and the linked sub-pixel 13, the linked sub-pixel 13 appears to be brighter than the not-linked non-defective sub-pixel 11 in a normally white mode where a transmittance or gray level is increased as the data voltage gets lower, and on the contrary, the linked sub-pixel 13 appears to be darker than the not-linked non-defective sub-pixel 14 in a normally black mode where a transmittance or gray level is decreased as the data voltage gets higher. Generally, a twisted nematic mode ("TN mode") where the pixel electrode and the common electrode of the liquid crystal cell are separately formed on two substrates which face each other with a liquid crystal therebetween and a vertical electric field is applied between the pixel electrode and the common electrode is driven in the normally white mode, but on the contrary, an in-plane switching mode ("IPS mode") where the pixel electrode and the common electrode of the liquid crystal cell are formed on the same substrate and a horizontal electric field is applied between the pixel electrode and the common electrode is driven in the normally black mode.

After performing the first repair process (S5) for the defective sub-pixel 10, the information for the location of the defective linked sub-pixel 13 and the information for the presence of the defective sub-pixel 10 can be stored at the inspection computer. The inspection computer may compute the charge characteristic compensation data for each gray level for each location of the defective linked sub-pixel 13 (S6). The charge characteristic compensation data can be data for compensating a charge characteristic of the linked defective sub-pixel 13 for the not-linked non-defective pixel 14.

At step S7, the upper/lower substrates are bonded together with a sealant or frit glass. The step of S7 can include an alignment film forming/rubbing process and/or a substrate bonding/liquid crystal injecting process. In an alignment film forming/rubbing process, an alignment film is spread on each of the upper substrate and the lower substrate of the display panel. The alignment film may be rubbed with a rubbing cloth or other application device. In a substrate bonding/liquid crystal injecting process, the upper substrate and the lower substrate may be bonded by use of a sealant. A liquid crystal and a spacer can be injected through a liquid crystal injection hole which is then later sealed off. Subsequently, test data of each gray level can be applied to the display panel, which includes the bonded upper/lower substrates, a display test picture. A first inspection of the presence of a defective sub-pixel may be performed by the electrical/magnetic inspection and/or the bare eye inspection at step S8.

If a panel defect is detected at step S8, the presence of the panel defect and/or information about the defect's location maybe stored in an inspection computer. At step s6, the inspection computer can compute panel defect compensation data for each gray level for each location of the panel defect.

If a defective sub-pixel is detected at step S8, a second repair process for the detected defective sub-pixel is performed at step S10. The second repair process (S10) can also be performed by electrically shorting or linking a defective sub-pixel 10 with an adjacent non-defective sub-pixel 11 having the same color as the defective sub-pixel 10 in the same manner as the first repair process. The first repair process S5 and the second repair process S10 can be identical or different in accordance with the manner in which the conductive link pattern 12 is formed.

After performing the second repair process at step S10 for the defective sub-pixel 10, location information for the linked defective sub-pixel 13 and the information for the presence a defective sub-pixel 10 can be stored at the inspection computer. The inspection computer can compute the charge characteristic compensation data for each gray level for each location of the link sub-pixel 13 at step S6.

At step S11, a display panel module is assembled. The assembly process may include mounting a drive circuit on the display panel where the upper/lower substrates are bonded, loading a case with the display panel on which the drive circuit is mounted, and/or attaching a backlight and/or other components. In the drive circuit mounting process, an output terminal of a tape carrier package ("TCP") on which the integrated circuits such as a gate drive integrated circuit ("IC"), a data drive IC, and/or other circuits and/or integrated circuits are mounted are connected to a pad part of the substrate. An input terminal of the TCP is connected to a printed circuit board ("PCB") on which a timing controller can be mounted. A non-volatile memory can be coupled to the PCB. The non-volatile memory may include electrically erasable programmable read only memory ("EEPROM"), extended display identification data rom ("EDID ROM"), erasable programmable read only memory ("EPROM"), flash memory, and/or other memories that renew and erase data.

The non-volatile memory may store the location data of the panel defect and/or linked sub-pixel, the panel defect compensation data, and/or charge characteristic compensation data. A compensation circuit which modulates digital video data that can be supplied to the panel defect and/or the linked sub-pixel 13 by use of the data stored at the non-volatile memory is mounted on the PCB. Alternatively, the compensation circuit can be made into one-chip with the timing controller embedded in the compensation circuit. The gate drive and/or data drive integrated circuits can be directly mounted on the substrate by a chip-on-glass ("COG") method other than a tape automated bonding ("TAB") method using the tape carrier package.

At step S12, the presence of a panel defect and/or defective sub-pixel 13 on the display may be determined. The determination may be based on defect information (e.g., presence and/or location) information stored in the inspection computer. If the panel defect and/or the defective sub-pixel exists in the display panel, the location data of the panel defect and/or the link sub-pixel stored at the inspection computer, the panel defect compensation data, and/or the charge characteristic compensation data computed by the inspection computer are stored at in the non-volatile memory at step S13. In some processes, the determination of a defect at step 12 and the storing of information in the non-volatile memory at step S13 may occur prior to assembling the module at step S11.

The inspection computer may supply the location data and compensation data to the non-volatile memory through a read only memory ("ROM") recorder. The ROM recorder can transmit the location data and the compensation data to the non-volatile memory through a user connector. The compensation data can be transmitted in series through the user connector. A serial clock, power source, and/or ground power source may be coupled to and/or transmitted to the non-volatile memory through the user connector.

At this moment, a compensation value in the compensation data computed by the inspection computer, i.e., the compensation data stored at the non-volatile memory, should be optimized for each location because the degree of brightness difference or color difference with the non-defective area is different in accordance with the location of the panel defect. Further, in consideration of a gamma characteristic, as in FIG. 6, the compensation value should be optimized. Accordingly, the compensation value can be set for each gray level in each of R, G, B sub-pixels or can be set for each gray level section (A, B, C, D) which include a plurality of gray levels, as shown in FIG. 6. For example, the compensation value is set to be an optimized value for each location, such as '+1' at the location of 'panel defect 1', '−1' at the location of 'panel defect 2', '0' at the location of 'panel defect 3', and also can be set to be an optimized value for each gray level section such as '0' at the 'gray level section A', '0' at the 'gray level section B', '1' at the 'gray level section C' and '1' at the 'gray level section D'. Accordingly, the compensation value can be made different for each gray level in the same panel defect location, and also can become different for each panel defect location in the same gray level. The compensation value like this is set to be the same value in each of the R, G, B data of one pixel when correcting brightness and is set by the unit of one pixel inclusive of the R, G, B sub-pixels. Further, the compensation value is differently set in each of the R, G, B data when correcting the color difference. For example, if red is shown more prominently in a specific panel defect location than a non defect location, the R compensation value becomes lower than the G, B compensation values.

Additionally, the charge characteristic of the linked sub-pixel 13 can also have a different degree of brightness or color difference compared with the not-linked non-defective sub-pixel. Thus the compensation value of the charge characteristic compensation data stored in the non-volatile memory should be optimized for each location of a linked sub-pixel 13. Furthermore, the compensation value of the charge characteristic compensation data stored in the non-volatile memory can be different for each gray level for the linked sub-pixel 13 so that it has the same gray level expression as the gray level expression of the not-linked non-defective sub-pixel 14. Alternatively, the charge characteristic compensation data may be different for each gray level area which includes a plurality of gray levels.

Monitor information data such as seller/manufacturer identification information (ID), and/or variables and characteristics of a basic display device, may be stored in the non-volatile memory. The location data and the compensation data can be stored at a separate storage space from the storage space at which the monitor information data are stored. In the case where the compensation data is stored in an EDID ROM non-volatile memory, the ROM recorder transmits the compensation data through a data display channel ("DDC"). In this situation, the user connector can be removed, therefore realizing a further cost reduction.

At step S14, a picture quality defect may be inspected a third time by the electrical/magnetic inspection and/or bare eye inspection. The third inspection may include modulating digital video data which is to be supplied to the linked sub-pixel 13 and/or the panel defect location. Location data and/or compensation data stored in the non-volatile memory can be used to modulate the digital video data. The modulated video data may be supplied to a liquid crystal display device where a test picture is displayed. If a picture quality defect is detected, yes at step S15, during the third inspection, information for the location where the picture quality defect appears can be stored at the inspection computer. The inspection computer can compute, at step S6 the compensation data for the picture quality defect for each gray level for the location where the picture quality defect appears. The location data for the picture quality defect and the computed compensation data can stored in the non-volatile memory at step S13. Alternatively, the picture quality defect detected in the third inspection of step of S14 can include the bright line information generated by the backlight in the case that the compensation value for the panel defect and/or the linked sub-pixel is not optimized.

If no picture quality defect is detected or is less than an allowable reference value, no at step S15, during the third inspection, the liquid crystal display device may be judged as a suitable product for shipping.(S16)

FIGS. 7 to 17 are diagrams showing various embodiments of forming a conductive link pattern 13 in the first and second repair processes (S5, S10).

Figure 7:
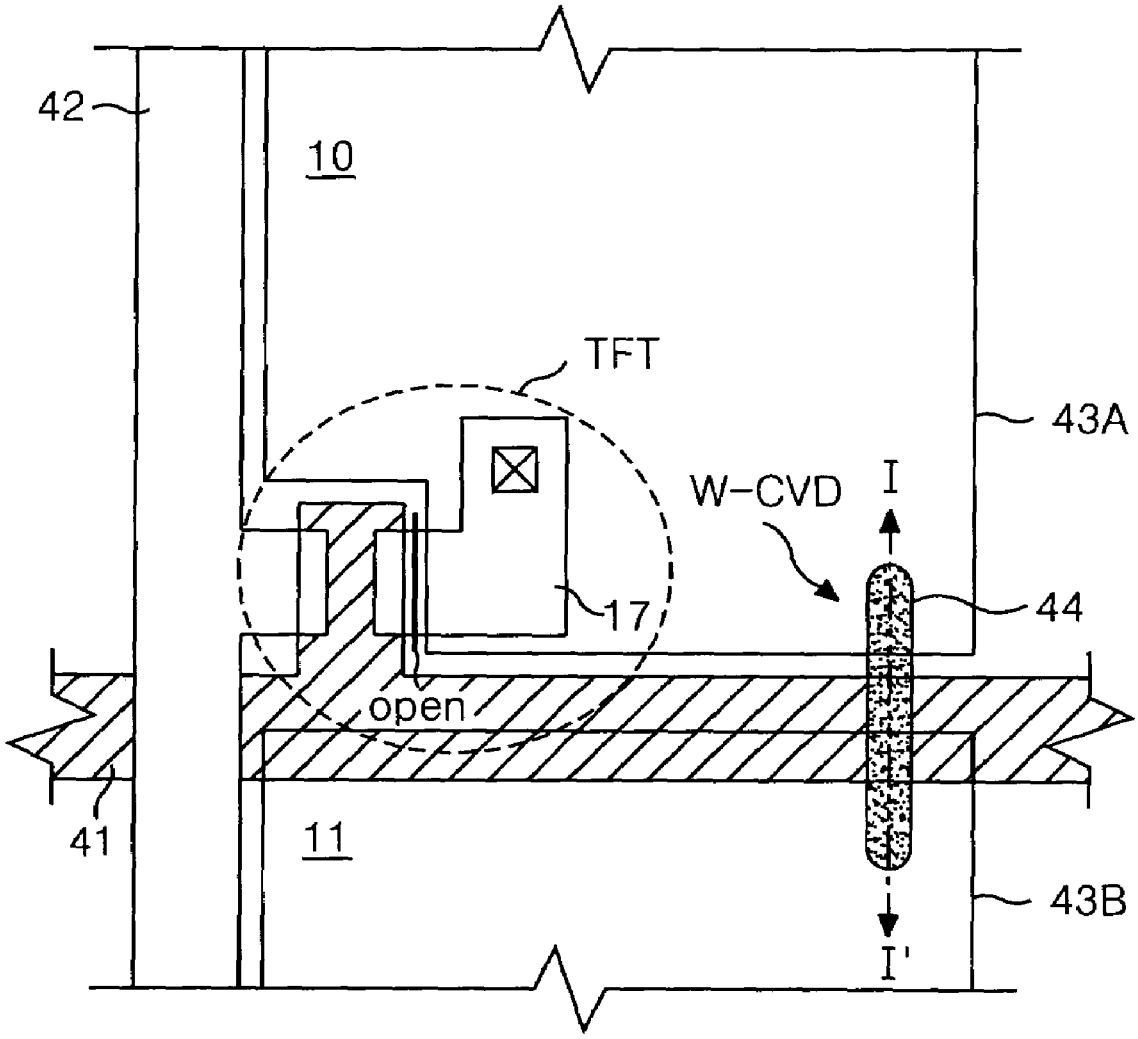
FIG. 7 is a plan view showing a defective pixel and an adjacent non-defective pixel of the same color.
Figure 8:
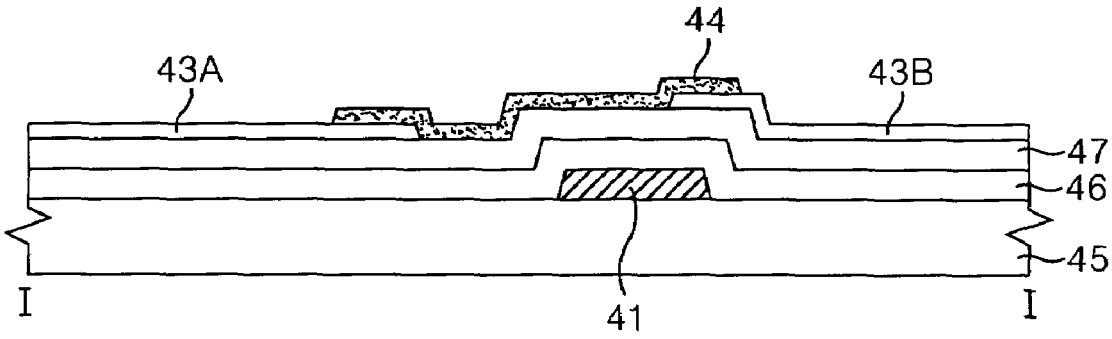
FIG. 8 is a cross sectional diagram showing the defective pixel and the adjacent non-defective pixel of the same color, by cutting along the line I-I' in FIG. 7 after a repair process.
Figure 9:
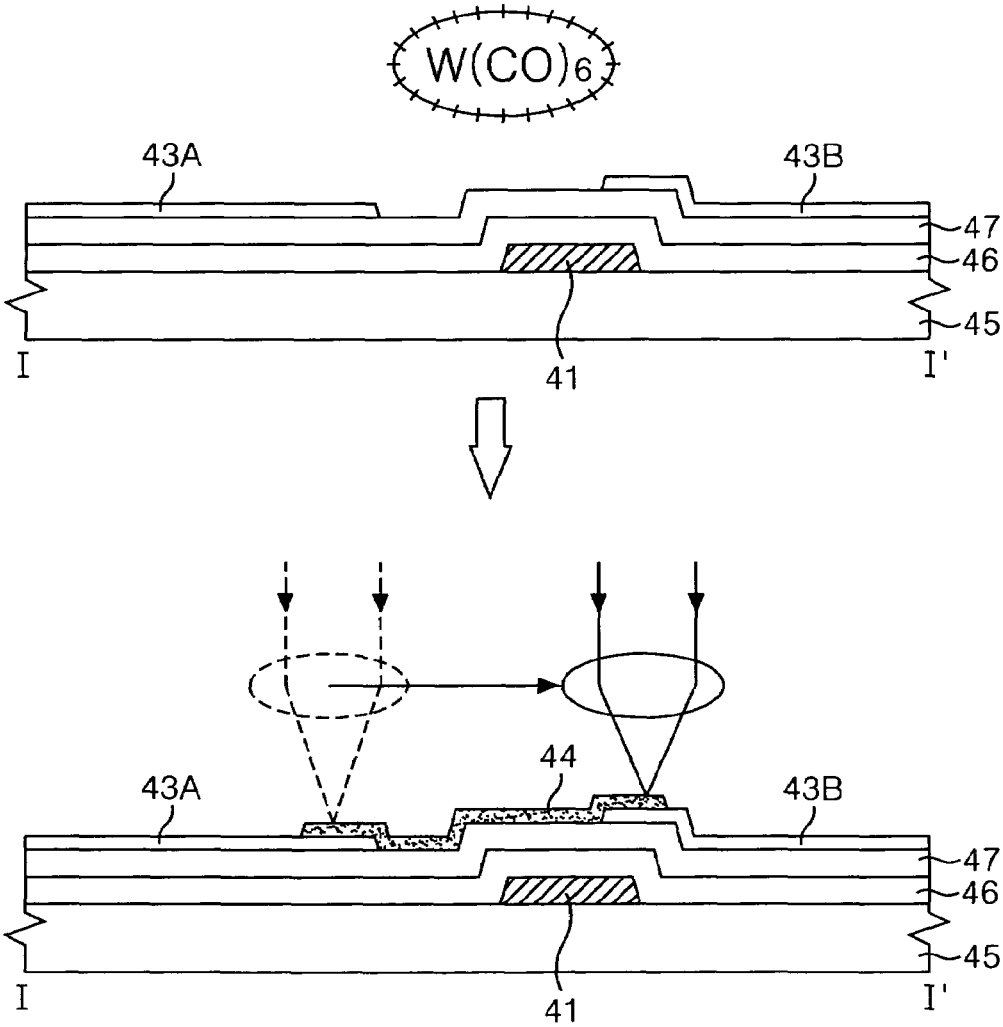
FIG. 9 is a cross sectional diagram representing a W-CVD process in a repair process.

FIGS. 7, 8 and 9 are diagrams for explaining a repair process of a liquid crystal display device of a TN mode. In FIGS. 7, 8 and 9, a link pattern 44 is formed, through a chemical vapor depositing ("W-CVD") process, on a pixel electrode 43A of the defective sub-pixel 10 and a pixel electrode 43B of an adjacent non-defective sub-pixel 11. The pixel electrode 43A, 43B are connected to a drain electrode 17 of TFT.

A gate line 41 and a data line 42 cross each other on a glass substrate 45 of the lower substrate, and a TFT is formed at the crossing part. A gate electrode of the TFT is electrically connected to the gate line 41, and a source electrode is electrically connected to the data line 42. The drain electrode of the TFT is electrically connected to the pixel electrodes 43A, 43B through a contact hole.

A gate metal pattern may include a gate line 41, and/or a gate electrode of the TFT that can be formed on the glass substrate 45. The gate metal pattern may be formed by a gate metal depositing process which can include aluminum Al, aluminum neodymium AlNd, a photolithography process, and/or an etching process.

A source/drain metal pattern may include a data line 42, and/or source and drain electrodes of the TFT that can be formed on a gate insulating film 46. The source/drain metal pattern may be formed by a source/drain metal depositing process of chrome Cr, molybdenum Mo, titanium Ti, a photolithography process, and/or an etching process.

The gate insulating film 46 for electrically insulating the gate metal pattern from the source/drain metal pattern can be formed of an inorganic insulating film such as silicon nitride SiNx or silicon oxide SiOx. A passivation film 47 covering the TFT, the gate line 41, and the data line 42 may be formed of an inorganic or organic insulating film.

The pixel electrodes 43A and 43B can be formed on the passivation film 47 by a process of depositing a transparent conductive metal such as indium tin oxide ITO, tin oxide TO, indium zinc oxide IZO or indium tin zinc oxide ITZO on the passivation film 47 and applying a photolithography process and an etching process. A data voltage can be supplied to the pixel electrodes 43A and 43B from the data line 42 through the TFT for a scanning period while the TFT is turned on.

The repair process is performed for the lower substrate before the substrate bonding/liquid crystal injecting process. The repair process establishes a current path between the source electrode of the TFT and the data line 42 or the drain electrode of the TFT. The pixel electrode 43A can be opened by a laser cutting process in order to intercept the current path between the pixel electrode 43A and the TFT of the defective sub-pixel 10. Tungsten (W) maybe deposited, through a W-CVD process, on the pixel electrode 43A of the defective sub-pixel 10 and the pixel electrode 43B of an adjacent non-defective sub-pixel 11 of the same color, and the passivation film 47 between the pixel electrodes 43A and 43B to form the link pattern 44. Alternatively, the link pattern 44 may be formed by the W-CVD process prior to opening the pixel electrode 43A.

The W-CVD process can focus a laser light on any one pixel electrode between the pixel electrodes 43A or 43B under a W(CO)6 atmosphere. The laser light is moved or scanned to another pixel electrode. As the laser light is moved, tungsten (W) is separated from the W(CO)6 in reaction of the laser light, and the tungsten (W) is deposited on the pixel electrodes 43A and 43B, and the passivation film 47 therebetween.

Figure 10:
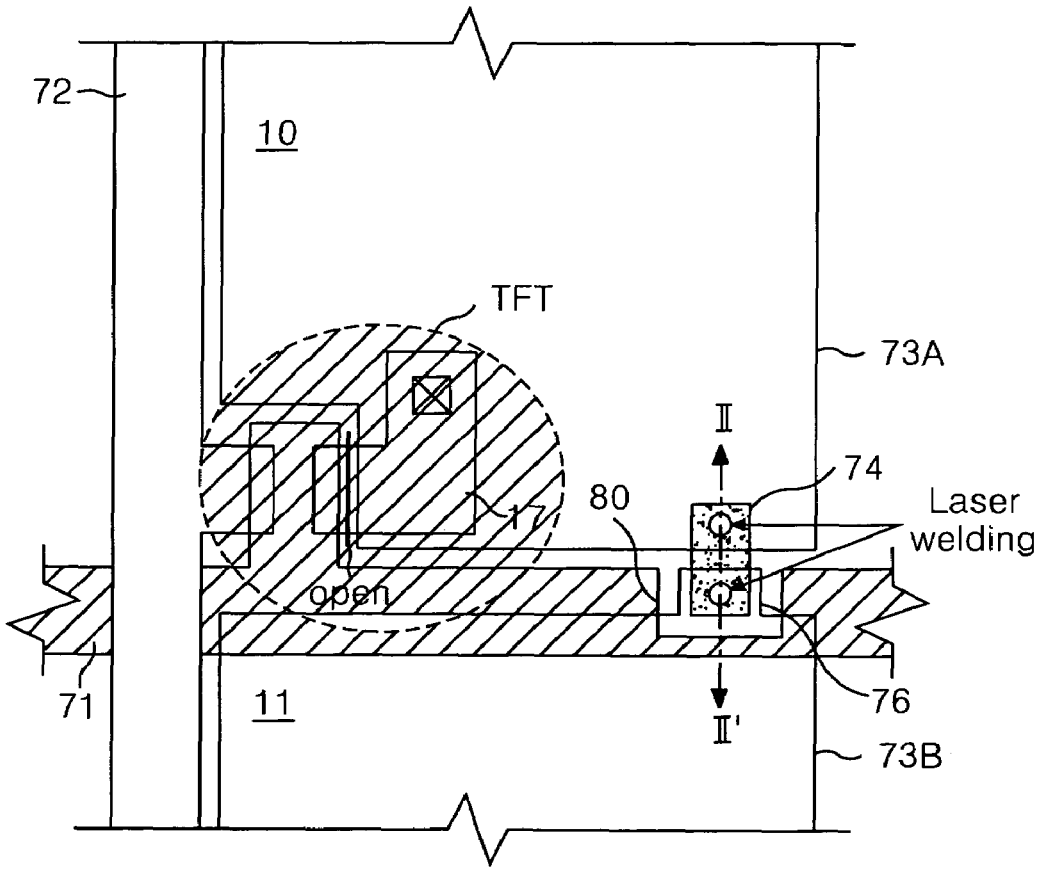
FIG. 10 is an alternate plan view showing a defective pixel and an adjacent non-defective pixel of the same color.
Figure 11:
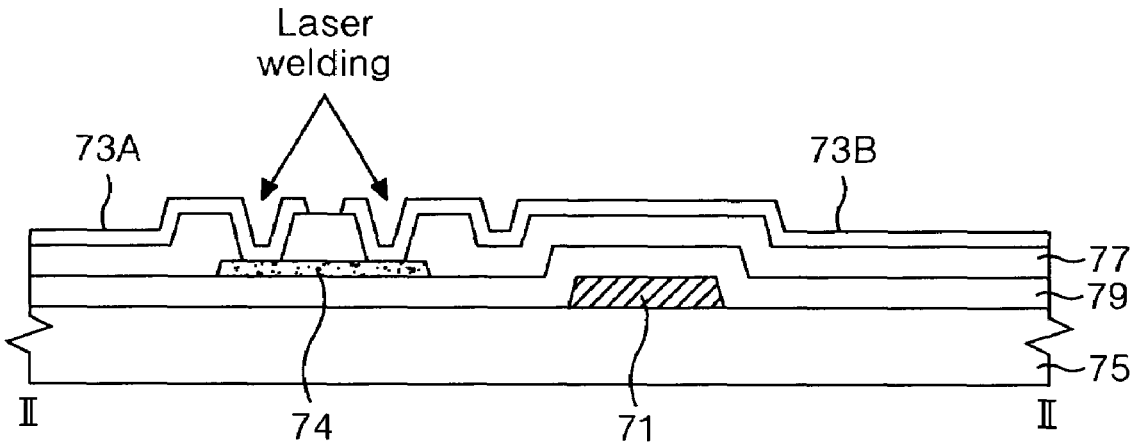
FIG. 11 is across sectional diagram showing the defective pixel and the adjacent non-defective pixel of the same color, by cutting along the line II-II' in FIG. 10 after a repair process.

FIGS. 10 and 11 are diagrams for explaining another repair process of a liquid crystal display device of a TN. In FIGS. 10 and 11, a link pattern 74 is overlapped with a pixel electrode 73A of defective sub-pixel 10 and a pixel electrode 73B of an adjacent non-defective sub-pixel 11 with a passivation film 77 therebetween.

A gate line 71 and a data line 72 cross each other on a glass substrate 75 of the lower substrate and a TFT is formed at the crossing part. A gate electrode of the TFT is electrically connected to the gate line 71, and a source electrode is electrically connected to the data line 72. The drain electrode of the TFT is electrically connected to the pixel electrodes 73A and 73B through a contact hole.

A gate metal pattern may include a gate line 71, and/or a gate electrode of the TFT that can be formed on the glass substrate 75. The gate metal pattern may be formed by a gate metal depositing process, a photolithography process, and an etching process.

The gate line 71 may include a concave pattern 80 which is separated by a designated distance so as not to overlap the link pattern 74. The concave pattern may and have a shape that encompasses the link pattern 74.

A source/drain metal pattern may include a data line 72, source and drain electrodes of the TFT, and/or the link pattern 74 that can be formed on a gate insulating film 79. The source/drain metal pattern may be formed by a source/drain metal depositing process, a photolithography process, and an etching process.

The link pattern 74 can be formed as an island pattern which is not connected to the gate line 71, the data line 72, and the pixel electrodes 73A and 73B before the repair process. One end of the link pattern 74 may overlap pixel electrode 73A and another end of the link pattern may overlap pixel electrode 73B.

The gate insulating film 79 can electrically insulate the gate metal pattern from the source/drain metal pattern. The passivation film 77 can electrically insulates the source/drain metal pattern from the pixel electrodes 73A and 73B.

The pixel electrodes 73A and 73B may be formed on the passivation film 77 by a process of depositing a transparent conductive metal, photolithography process, and etching process. The pixel electrodes 73A and 73B can include an extended part 76 from one side of the upper end. The pixel electrodes 73A and 73B may overlap with one end of the link pattern 74 by the extended part 76. A data voltage can be supplied to the pixel electrodes 73A and 73B from the data line 72 through the TFT for a scanning period while the TFT is turned on.

Figure 12:
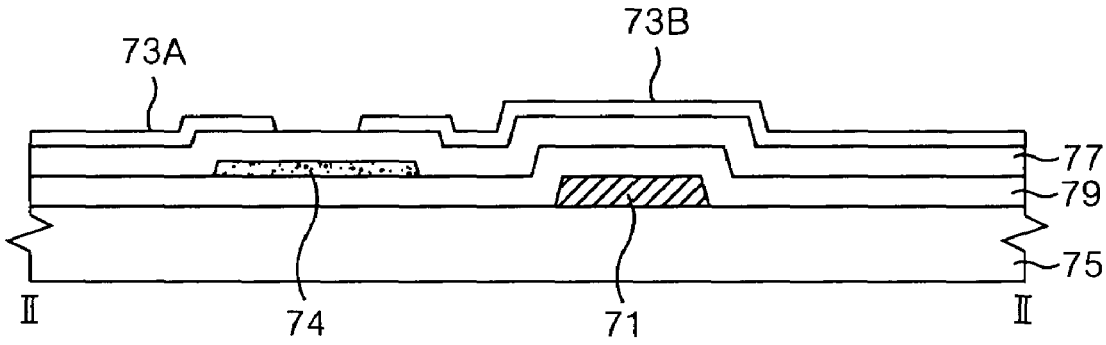
FIG. 12 is across sectional diagram showing the defective pixel and the adjacent non-defective pixel of the same color, by cutting along the line II-II' in FIG. 10 before a repair process.

The repair process is performed for the lower substrate before the substrate bonding/liquid crystal injecting process, or for the panel after the substrate bonding/liquid crystal injecting process. The repair process establishes a current path between the source electrode of the TFT and the data line 72 or the drain electrode of the TFT. The pixel electrode 73A can be opened by a laser cutting process in order to intercept the current path between the pixel electrode 73A and the TFT of the defect pixel. The repair process irradiates the pixel electrodes 73A and 73B as shown in FIG. 10, by use of a laser welding process. The pixel electrodes 73A and 73B, and the passivation film 77 are melted by the laser light, and as a result, the pixel electrodes 73A and 73B are connected to the link pattern 74. Alternatively, the line breaking process and the laser welding process can be performed in the opposite order. FIG. 12 shows the pixel electrodes 73A and 73B, and the link pattern 74 which are electrically separated by the passivation film 77 before the laser welding process.

Figure 13:
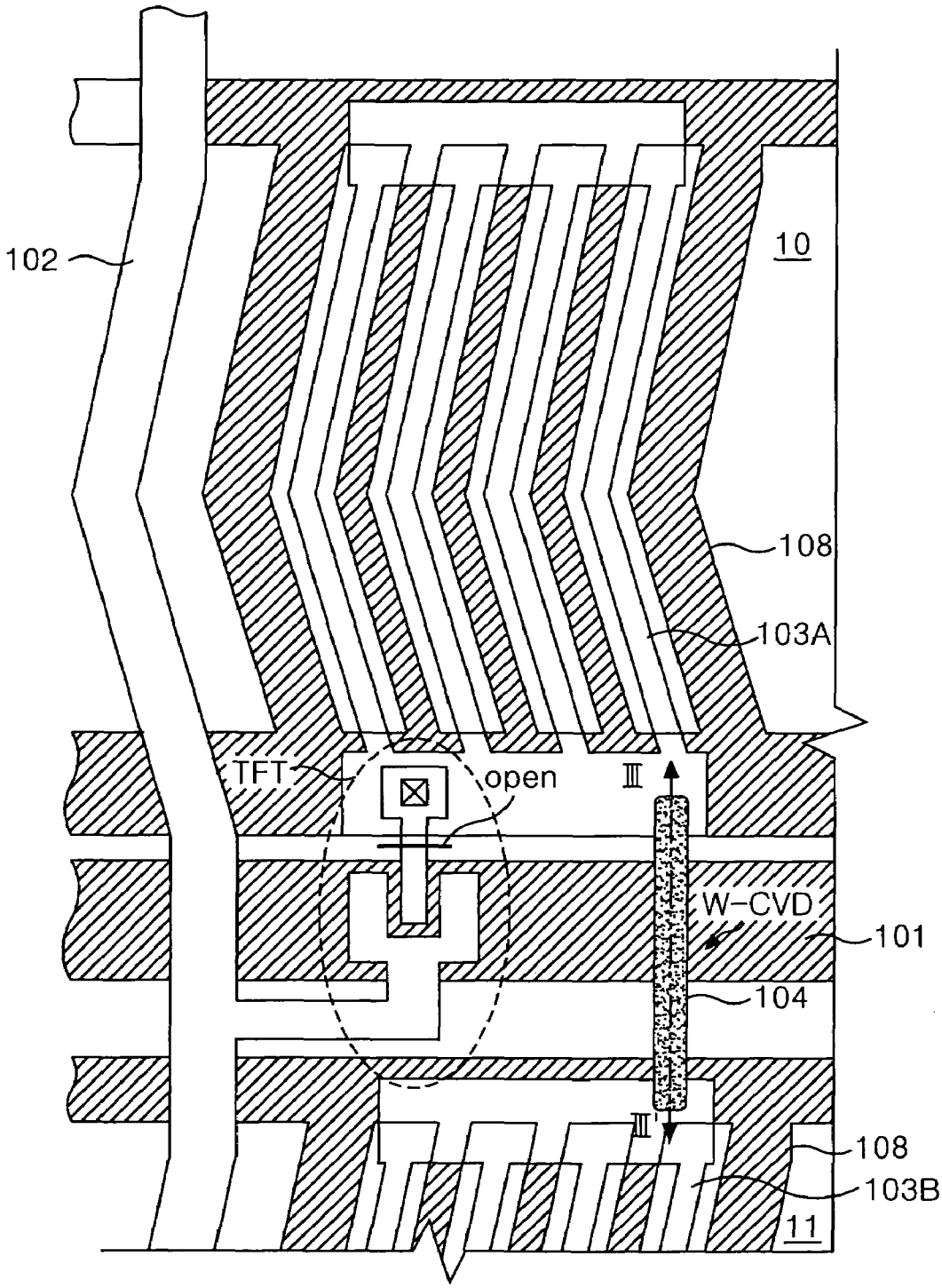
FIG. 13 is a third alternate plan view showing a defective pixel and an adjacent non-defective pixel of the same color.
Figure 14:
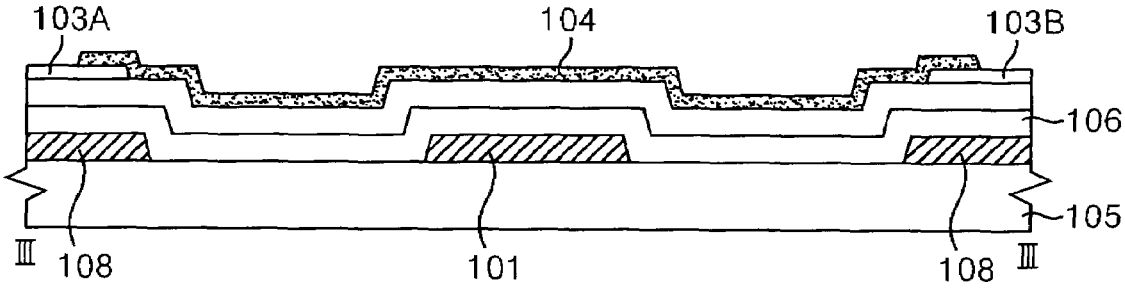
FIG. 14 is across sectional diagram showing the defective pixel and the adjacent non-defective pixel of the same color, by cutting along the line III-III' in FIG. 13 after a repair process.

FIGS. 13 and 14 are diagrams for explaining a repair process of a liquid crystal display device of an IPS. In FIGS. 13 and 14, a link pattern 104 is formed, through a chemical vapor deposition (W-CVD) process, on a pixel electrode 103A of the defective sub-pixel 10 and a pixel electrode 103B of an adjacent non-defective sub-pixel 11.

A gate line 101 and a data line 102 cross each other on a glass substrate 105 of the lower substrate and a TFT is formed at the crossing part. A gate electrode of the TFT is electrically connected to the gate line 101, and a source electrode is electrically connected to the data line 102. The drain electrode of the TFT is electrically connected to the pixel electrodes 103A and 103B through a contact hole.

A gate metal pattern may include a gate line 101, a gate electrode of the TFT, and/or a common electrode 108, that can be formed on the glass substrate 105. The gate metal pattern may be formed by a gate metal depositing process, a photolithography process, and an etching process. The common electrode 108 is connected to all liquid crystal cells to supply a common voltage Vcom to the liquid crystal cells. The horizontal electric field is applied to the liquid crystal cells by a common voltage Vcom applied to the common electrode 108 and a data voltage applied to the pixel electrodes 103A and 103B.

A source/drain metal pattern may include a data line 102, and/or source and drain electrodes of the TFT that can be formed on a gate insulating film 106. The source/drain metal pattern may be formed by a source/drain metal depositing process, a photolithography process, and an etching process.

The pixel electrodes 103A and 103B are formed on the passivation film 107 by a process which can include depositing a transparent conductive metal, a photolithography process, and an etching process. A data voltage can be supplied to the pixel electrodes 103A and 103B from the data line 102 through the TFT for a scanning period while the TFT is turned on.

The repair process is performed for the lower substrate before the substrate bonding/liquid crystal injecting process. The repair process establishes a current path between the source electrode of the TFT and the data line 102 or the drain electrode of the TFT. The pixel electrode 103A can be opened by a laser cutting process in order to intercept the current path between the pixel electrode 103A and the TFT of the defect sub-pixel 10. Tungsten (W) is deposited, through a W-CVD process, on the pixel electrode 103A of the defective sub-pixel 10, and the pixel electrode 103B of an adjacent non-defective sub-pixel 11 of the same color, and the passivation film 107 between the pixel electrodes 103A, 103B to form the link pattern 104. Alternatively, the link pattern 44 may be formed by the W-CVD process prior to opening the pixel electrode 103A.

Figure 15:
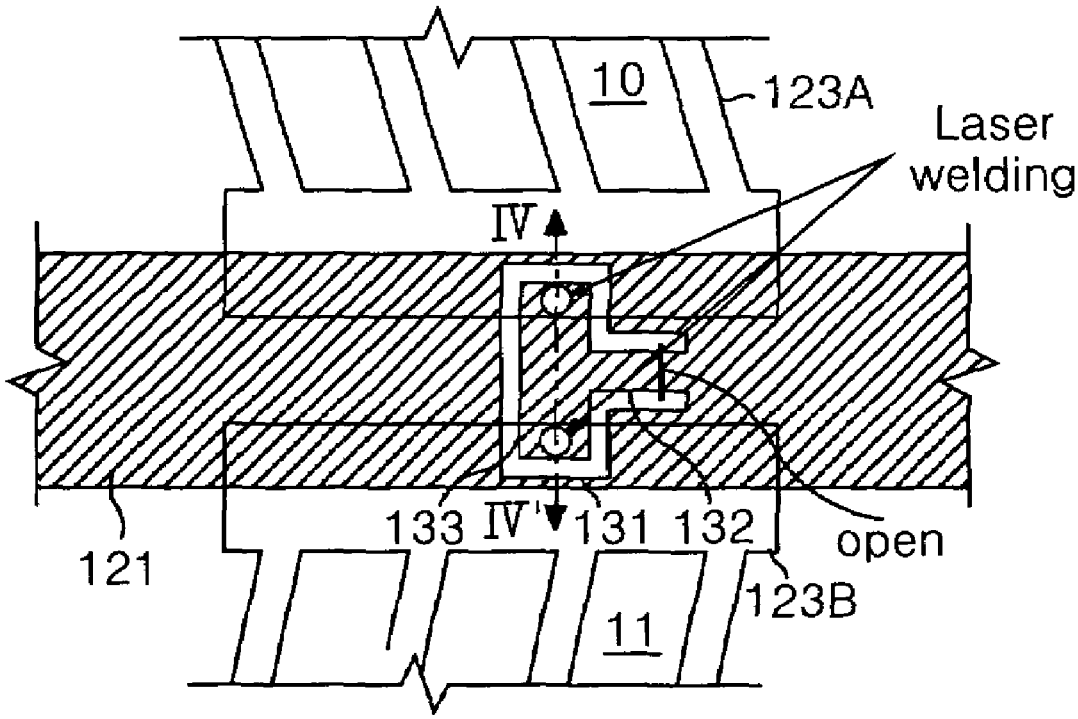
FIG. 15 is a fourth alternate plan view showing a defective pixel and an adjacent non-defective pixel of the same color.
Figure 16:
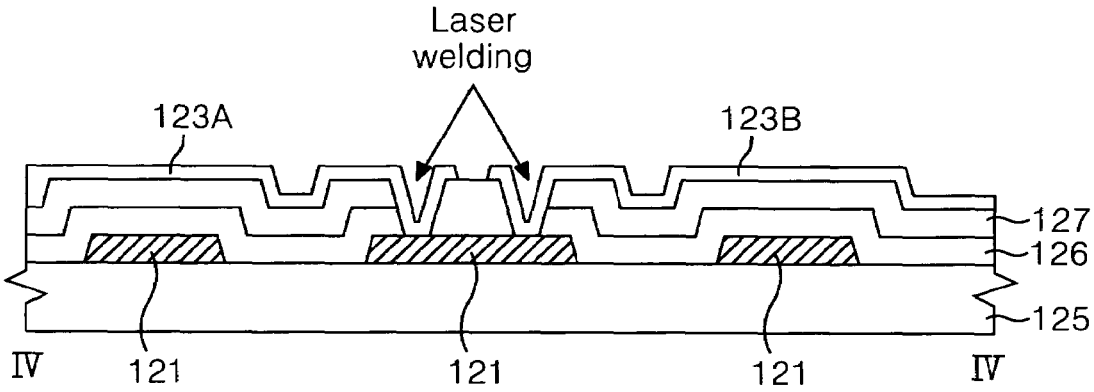
FIG. 16 is across sectional diagram showing the defective pixel and the adjacent non-defective pixel of the same color, by cutting along the line IV-IV' in FIG. 15 after a repair process.
Figure 17:
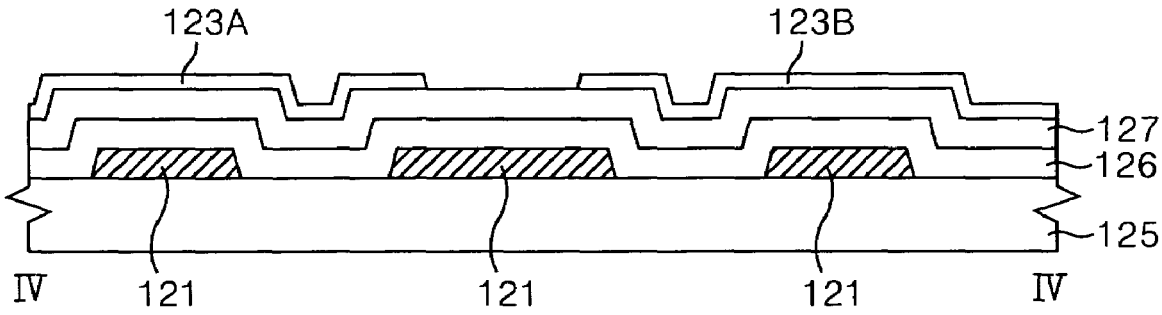
FIG. 17 is across sectional diagram showing the defective pixel and the adjacent non-defective pixel of the same color, by cutting along the line IV-IV' in FIG. 15 before a repair process.

FIGS. 15 to 17 are diagrams for explaining another repair process of a liquid crystal display device of an IPS mode. In FIGS. 15 to 17, a common electrode for applying a horizontal electric field to the liquid crystal cells together with the data metal pattern such as the data line, the TFT, and the pixel electrode are omitted.

In FIGS. 15 to 17, the gate line 121 includes a neck part 132. A head part 133 is connected to the neck part 132 and has an area which is extended. An aperture pattern 131 is removed in a 'C' shape in the vicinity of the neck part 132 and the head part 133.

A gate metal pattern may include a gate line 121, a gate electrode of the TFT (not shown), and/or a common electrode that can be formed on the glass substrate 125. The gate metal pattern maybe formed by a gate metal depositing process, a photolithography process, and an etching process.

The pixel electrodes 123A and 123B may be formed on the passivation film 127 by a process which can include depositing a transparent conductive metal, photolithography, and etching.

In the repair process as shown in FIG. 16, the neck part 132, of the gate line, can be opened by a laser cutting process. One side end of the head part 133 overlaps the pixel electrode 123A of the defective sub-pixel 10 with the gate insulating film 126 and the passivation film 127, and the other side end of the head part 133 overlaps the pixel electrode 123B of an adjacent non-defective sub-pixel 11 with the gate insulating film 126 and the passivation film 127 therebetween.

The repair process is performed for the lower substrate before the substrate bonding/liquid crystal injecting process, or for the panel after the substrate bonding/liquid crystal injecting process. The repair process establishes a current path between the source electrode of the TFT and the data line or the drain electrode of the TFT. The neck part 132 can be opened by a laser cutting process in order to intercept the current path between the pixel electrode 123A and the TFT of the defective pixel. The repair process irradiates the pixel electrodes 123A and 123B which are adjacent to both ends of the head parts 133, as shown in FIG. 13, by use of a laser welding process. The pixel electrodes 123A and 123B, the passivation film 127, and the gate insulating film 126 are melted by the laser light, and as a result, the head part 133 becomes an independent pattern separated from the gate line 121, and the pixel electrodes 103A and 103B are connected to the head part 133. Alternatively, connections between the head part 133 and pixel electrodes 123A and 123 B may be formed before the neck part 132 is opened by the laser cutting process.

A picture quality controlling method modulates digital video data which are to be supplied to the location where the picture quality defect appears in the display screen. The digital video data may be modulated with the compensation data which is computed by the fabricating method of the foregoing liquid crystal display device so as to supply to the location where the picture quality defect appears, thereby compensating the picture quality defect. The modulation data may vary depending on the type of picture quality defect. For example, for a defective sub-pixel, the data modulation may increase or decrease the gray level which can be expressed by the digital video data. Alternatively, for a panel defect area, the data modulation may be sub-divided to express the gray level.

The picture quality controlling method may be divided into a first compensation step for the panel defect and a second compensation step for the linked sub-pixel. In the first compensation step of the picture quality controlling method, Red, Green, Blue ("RGB") data of m/m/m bits which is to be displayed at the panel defect location are converted into brightness Y and color difference U/V data of n/n/n bits (n is an integer higher than m). The brightness data Y which are to be displayed in the panel defect location among the converted Y/U/V data of n/n/n bits are increased or decreased by the panel defect compensation data to be modulated. This information will then be converted back into the RGB data of m/m/m bits. For example, the RGB data of 8/8/8 bits are converted into the Y/U/V data of 10/10/10 bits where the number of bits is extended. After adding or subtracting the panel defect compensation data to or from the extended bit of the Y data, the Y/U/V data of 10/10/10 bits where the Y data are increased or decreased are converted again into the RGB data of 8/8/8 bits.

Figure 18A:
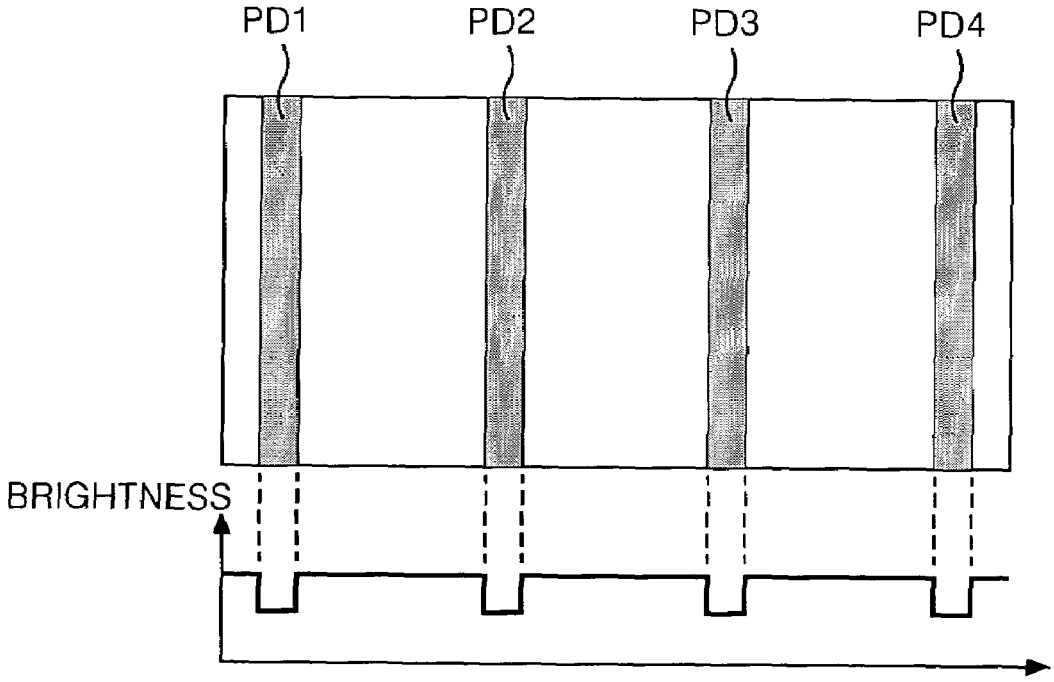
FIG. 18A is a diagram representing a panel defect.

Alternatively, the panel defect compensation data may be varied in accordance with the panel defect location and the gray level of the video data which are to be displayed in the panel defect location. For example, as shown in FIG. 18A, if there are panel defect areas 1 to 4 (PD1 to PD4) on the display panel, in order to compensate the brightness information of the digital video data which are to be displayed in the panel defect areas 1 to 4 (PD1 to PD4), the panel defect compensation data for each gray level area, for each location (area) of each panel defect area can be stored in a non-volatile mememory, as shown in TABLE 1.

TABLE 1

| Classification | Gray level area | PD1 | PD2 | PD3 | PD4 |
|---|---|---|---|---|---|
| Gray Level Section 1 | 00000000(0)~00110010(50) | 01(1) | 00(0) | 01(1) | 01(1) |
| Gray Level Section 2 | 00110011(51)~00111000(112) | 10(2) | 00(0) | 01(1) | 10(2) |
| Gray Level Section 3 | 01110001(113)~10111110(190) | 11(3) | 01(1) | 10(2) | 11(3) |
| Gray Level Section 4 | 10111111(191)~11111010(250) | 00(0) | 01(1) | 10(2) | 11(3) |

In the case where the panel defect compensation data stored in the non-volatile memory is as in TABLE 1, the first compensation step of the picture quality controlling method converts the RGB data of 8/8/8 bits which are to be supplied to the location of the panel defect area 1 (PD1) to the Y/U/V data of 10/10/10 bits. If the upper 8 bits of the Y data is '01000000(64)' corresponding to the gray level section 2, then '10(2)' is added to the lower 2 bits of the Y data to modify the Y data, and the modified Y/U/V data is again converted into the RGB data of 8/8/8 bits. Similarly, the first compensation step of the picture quality controlling method converts the RGB data of 8/8/8 bits which are to be supplied to the location of the panel defect area 4 (PD4) to the Y/U/V data of 10/10/10 bits. If the upper 8 bits of the Y data is '10000000 (128)' corresponding to the gray level section 3, then '11(3)' is added to the lower 2 bits of the Y data to modify the Y data, and the modified Y/U/V data is again converted into the RGB data of 8/8/8 bits.

In this way, the first compensation step of the picture quality controlling method converts the RGB video data which are to be displayed at the panel defect location into a brightness component and a color difference component. By paying attention to the fact that the human eye is more sensitive to the brightness difference than to the color difference, and controlling the brightness of the panel defect location by extending the number of bits of the Y data which includes the brightness information it is possible to finely control the brightness at the panel defect location of the flat panel display device.

In the second compensation step of the picture quality controlling method the digital video data which are to be supplied to the linked sub-pixel may be increased or decreased to a pre-set charge characteristic compensation data.

Figure 18B:
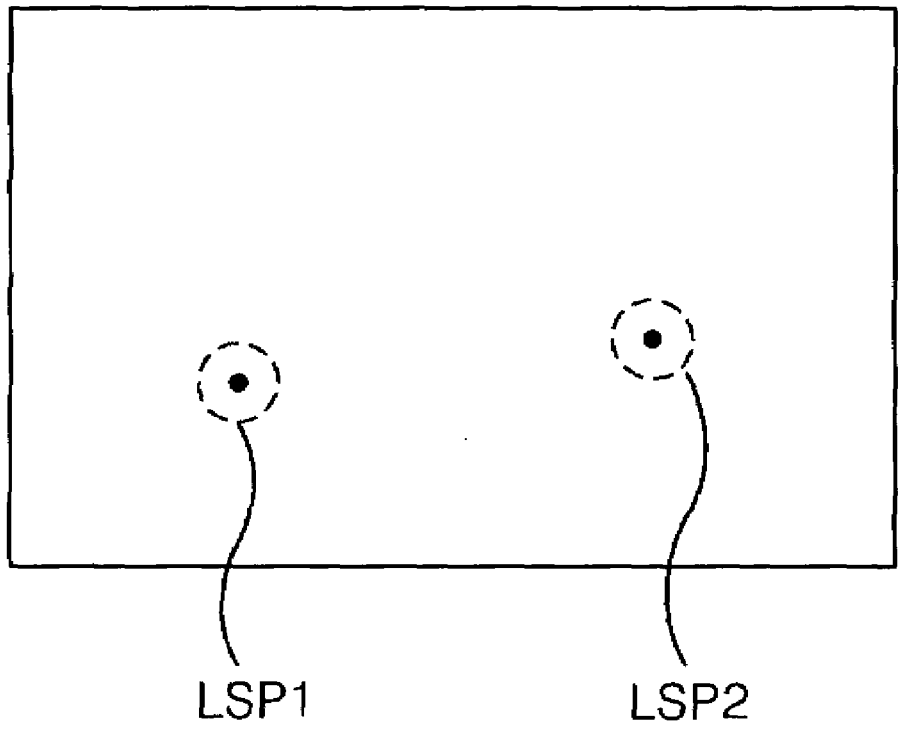
FIG. 18B is a diagram representing a linked pixel.

For example, as shown in FIG. 18B, when the linked sub-pixels LSP1 and LSP2 exist on the display panel, the panel defect compensation data for each location of each linked sub-pixel LSP1 and LSP2 and for each gray level area can be stored in a non-volatile memory, as shown in TABLE 2. For example, the compensation data can be used to compensate the charge characteristic of the linked sub-pixels LSP1 and LSP2.

TABLE 2

| Classification | Gray Level Area | Link Sub-Pixel 1 | Link Sub-Pixel 2 |
|---|---|---|---|
| Gray Level Section 1 | 00000000(0)~00110010(50) | 00000100(4) | 00000010(2) |
| Gray Level Section 2 | 00110011(51)~00111000(112) | 00000110(6) | 00000100(4) |
| Gray Level Section 3 | 01110001(113)~10111110(192) | 00001000(8) | 00000110(6) |

In the case where the panel defect compensation data stored in the non-volatile memory is as shown in TABLE 2, the digital video data which are supplied to the linked sub-pixel LSP1 is '01000000(64)' corresponding to the 'gray level section 2'. The second compensation step modulates the digital video data which are to be supplied to the linked sub-pixel LSP1 to '01000100(68)' by adding '00000100(4)' to '01000000(64)'. If the digital video data which are supplied to the linked sub-pixel LSP2 is '10000000(128)' corresponding to the 'gray level section 3', the second compensation step modulates the digital video data which are to be supplied to the linked sub-pixel LSP2 to '10000110(134)' by adding '00000110(6)' to '10000000(128)'.

The second compensation step of the picture quality controlling method modulates the digital video data which are to be displayed in a linked sub-pixel 13 with the compensation data which may be pre-set to compensate for the charge characteristic of the linked sub-pixel. Thus, the degree of perception of the defective sub-pixel may be increased or decreased and the charge characteristic of the defective sub-pixel can be compensated for.

Figure 18C:
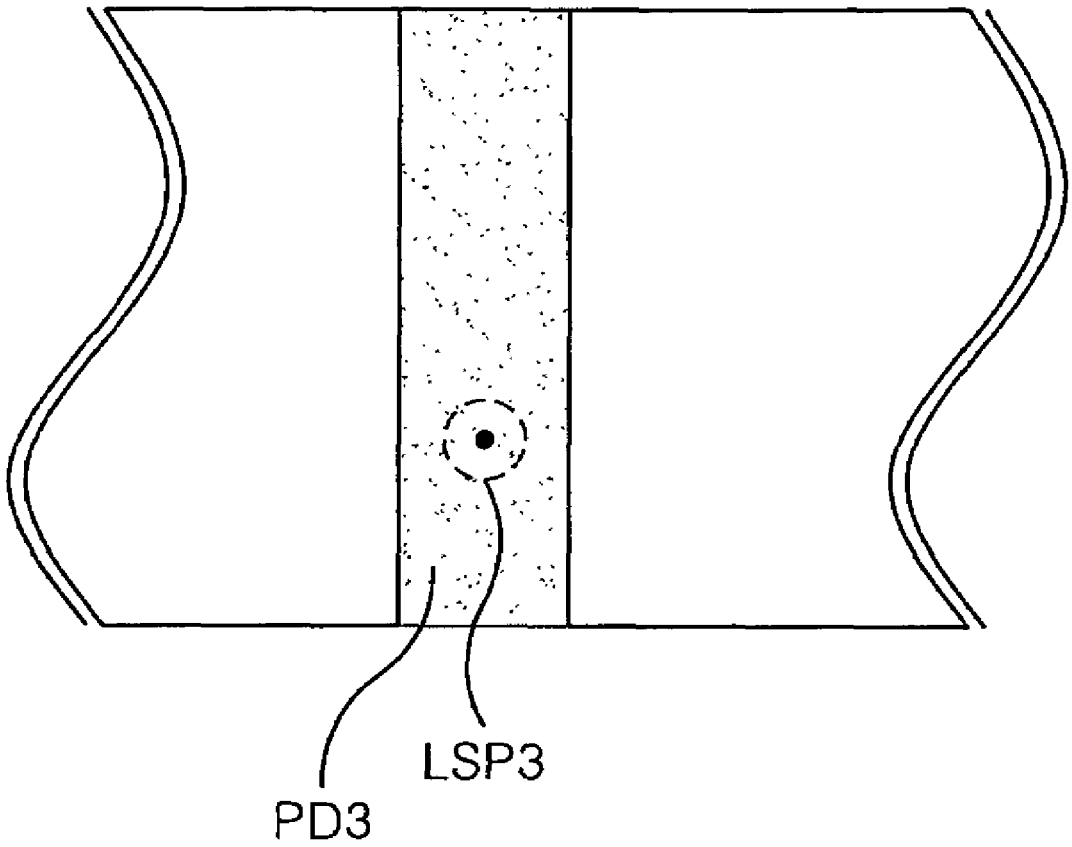
FIG. 18C is a diagram representing a location of a panel defect that is overlapped with a location of a linked pixel.

Alternatively, as shown in FIG. 18C, the linked sub-pixel LSP3 can exist within the panel defect area PD3 on the display panel. In such a case, where the location of the panel defect area and the linked sub-pixel location overlap, the second compensation part computes the charge characteristic compensation data in consideration of the panel defect compensation data value computed at the first compensation part. For example, if the panel defect compensation data in a specific gray level area is determined to be '+2' and the charge characteristic compensation data is determined to be '+6', in case where the panel defect area and the link pixel overlap, the charge characteristic for the linked sub-pixel is compensated by '+2' in the first compensation part, and the charge characteristic in the second compensation part is compensated by '+4' (+6−2).

Figure 19:
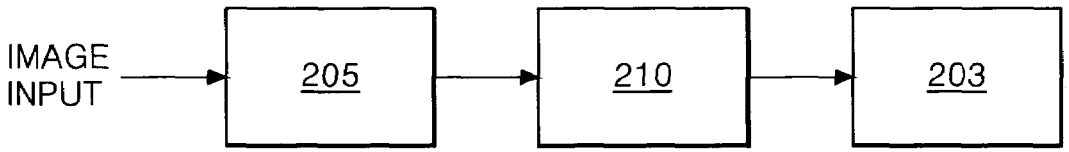
FIG. 19 is a partial block diagram of a display device that can control picture quality.

FIG. 19 is a partial block diagram of a liquid crystal device which can control picture quality. The liquid crystal display device can include a compensation circuit 205 which receives video data and modulates the received data. The modulated received data can be supplied to driver 210 which drives display panel 203.

Figure 20:
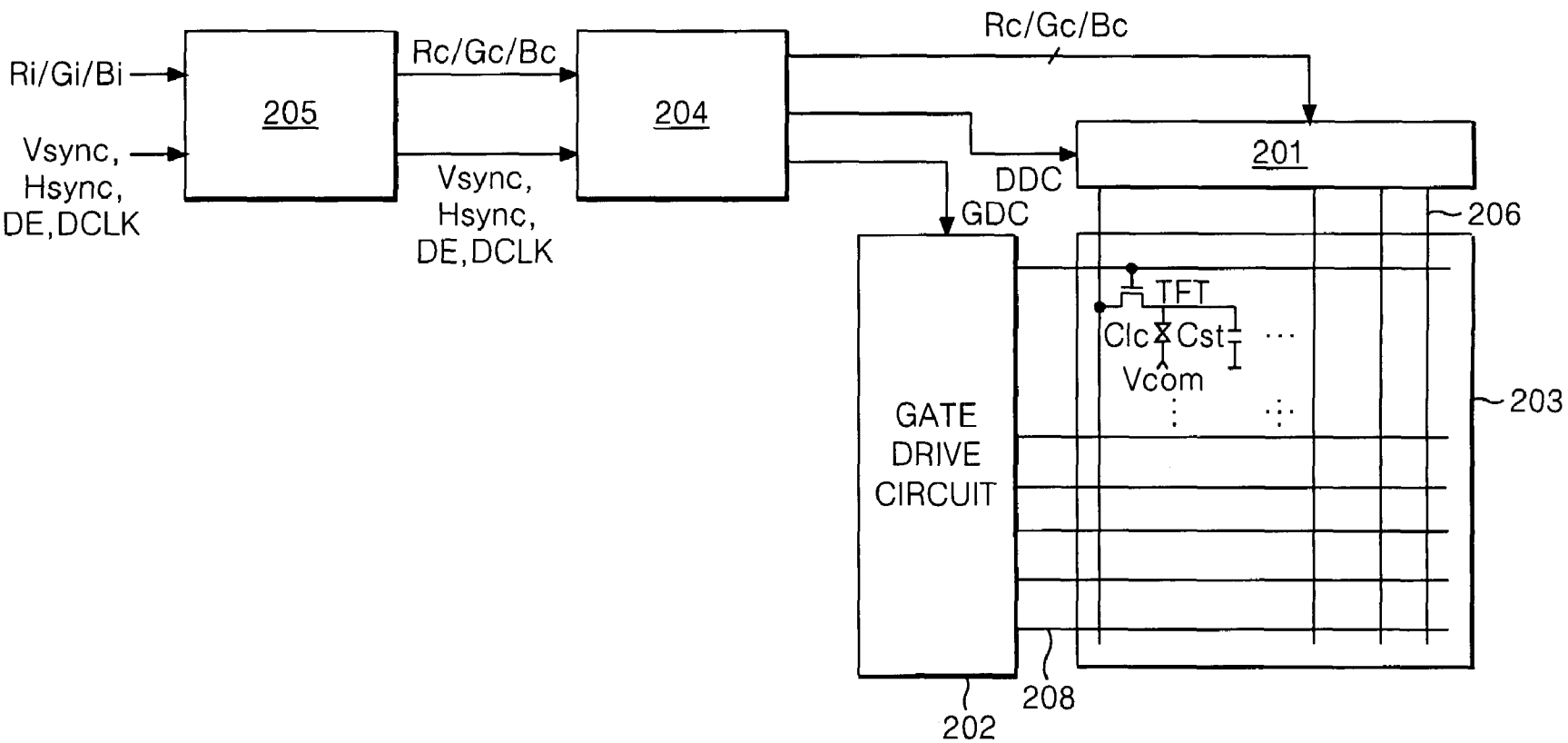
FIG. 20 is a second partial diagram of a display device that can control picture quality.

FIG. 20 is a second partial diagram of a liquid crystal display device. In FIG. 20, the liquid crystal display device includes a display panel 203 where data lines 206 cross gate lines 208 and a TFT for driving a liquid crystal cell Clc is formed at each of the crossing parts thereof. A compensation circuit 205 can generate compensated digital video data Rc/Gc/Bc. A data drive circuit 201 may convert the compensated digital video data Rc/Gc/Bc into an analog data voltage to supply to the data lines 206. A gate drive circuit 202 can supply a scan pulse to the gate lines 206. A timing controller 204 may control the data drive circuit 201 and the gate drive circuit 202.

The display panel 203 can have liquid crystal molecules injected between two substrates, i.e., a TFT substrate and color filter substrate. The TFT, formed at the crossing part of the data lines 206 and the gate lines 208, can supply the data voltage from the data line 206 to the pixel electrode of the liquid crystal cell Clc in response to the scan signal from the gate line 208. A black matrix, a color filter and a common electrode (not shown) can be formed on the color filter substrate. Alternatively, the common electrode can be formed on the TFT substrate in a horizontal electric field applying an in-plane switching mode ("IPS") or a fringe field switching mode ("FFS"). Polarizers having a vertical polarizing axis to each other are respectively adhered to the TFT substrate and the color filter substrate.

The compensation circuit 205 receives the input digital video data Ri/Gi/Bi from a system interface to modulate the input digital video data Ri/Gi/Bi which are to be supplied to the panel defect location, thereby generating the corrected digital video data Rc/Gc/Bc.

Figure 21:
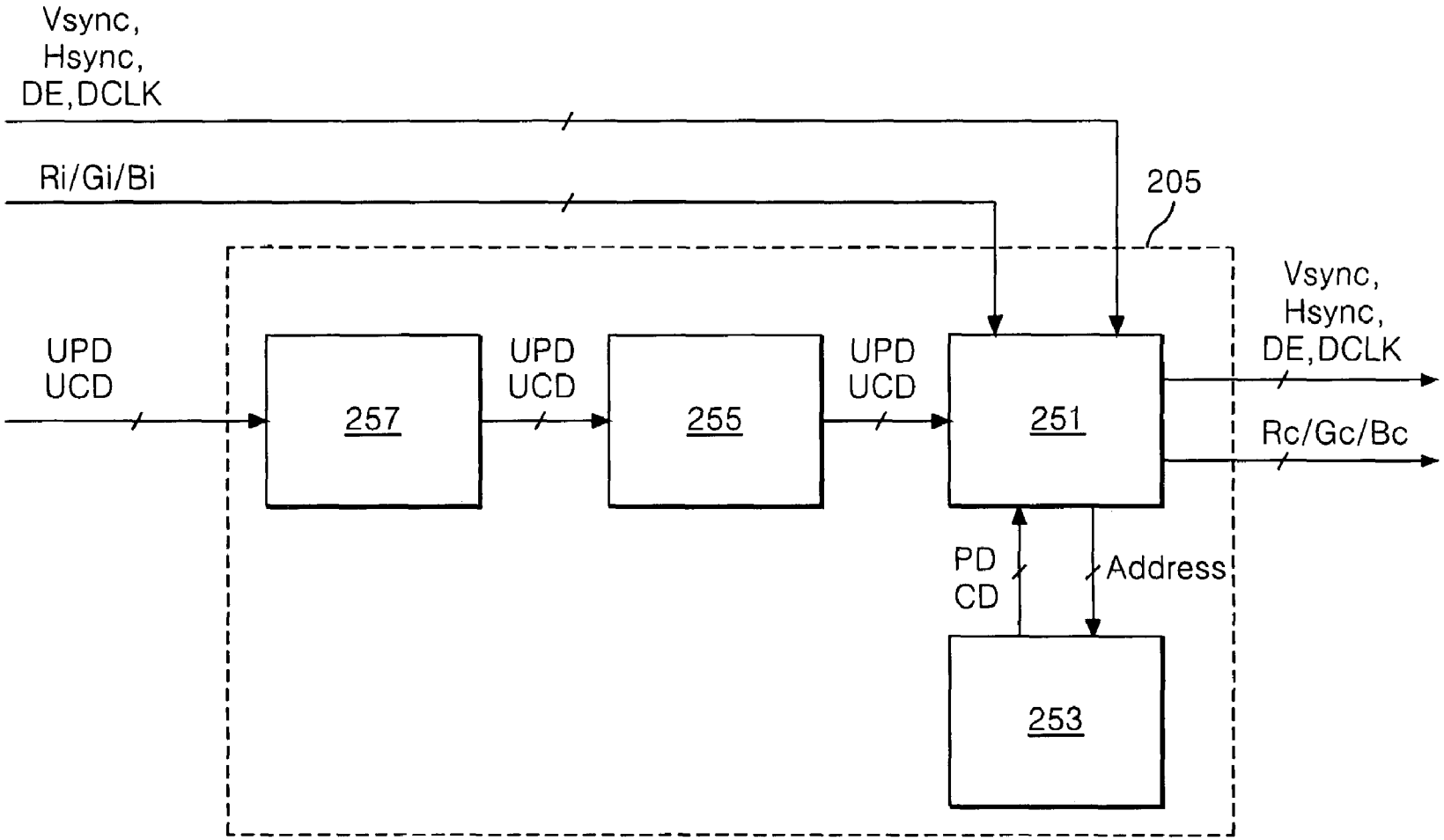
FIG. 21 is a partial diagram of a compensation circuit.

FIG. 21 is a partial diagram of a compensation circuit 205. The compensation circuit 205 can include non-volatile memory 253, which may be an EEPROM; a compensator 251, an interface circuit 257, and/or a register 255. The non-volatile memory 253 can store a location data ("PD") indicating the location of a linked sub-pixel and/or the panel defect area on the display panel 203. The non-volatile memory 253 may also store compensation data ("CD"). The compensation data may be a panel defect compensation data for compensating the brightness which is to be display in the panel defect area, and/or a charge characteristic compensation data for compensating the charge characteristic of the linked sub-pixel. The compensator 251 can generate the compensated digital video data Rc,Gc,Bc by modulating the input video digital data Ri/Gi/Bi according to the location data PD and/or the compensation data CD stored in the non-volatile memory 253. The interface circuit 257 can communicate between the compensator 251 and an external system. The register 225 may temporarily store data which are to be stored in the non-volatile memory 253 through the interface circuit 257.

The location data PD and the compensation data CD stored in the non-volatile memory 253 can be determined differently in accordance with the gray level of the input digital video data Ri/Gi/Bi and in accordance with the location of the panel defect area and the location of the link pixel. The compensation value according to the gray level may include a compensation value set in correspondence to each gray level of the input digital video data Ri/Gi/Bi or a compensation value set in correspondence to the gray level section which includes two or more gray levels. In case of setting the compensation value in correspondence to the gray level section, information for the gray level section, i.e., information of the gray level included in the gray level section, is also stored at the non-volatile memory 253. The non-volatile memory 253 can renew the data for the compensation value and the panel defect location by the data inputted through a ROM recoder.

The interface circuit 257 may be a configured to communicate between the compensation circuit 205 and an external system. The interface circuit 257 can be designed according to the I2C communication standard protocol. The external system can read the data stored in the non-volatile memory 253 through the interface circuit 257 and/or modify the data. For instance, some or all of the location data PD and/or the compensation data CD stored in the non-volatile memory 253 may be are required to be automatically or manually renewed for reasons such as a change in process and/or a difference between an application model. A user may supply compensation data UCD and location data UPD, which are desired to be renewed, from the external system, so that the data stored in the non-volatile memory 253 can be modified. The user supplied location data UPD and the compensation data UCD may be transmitted through the interface circuit 257 and temporarily stored in the register 255 in order to renew the location data PD and the compensation data CD stored in the non-volatile memoy 253.

Figure 22:
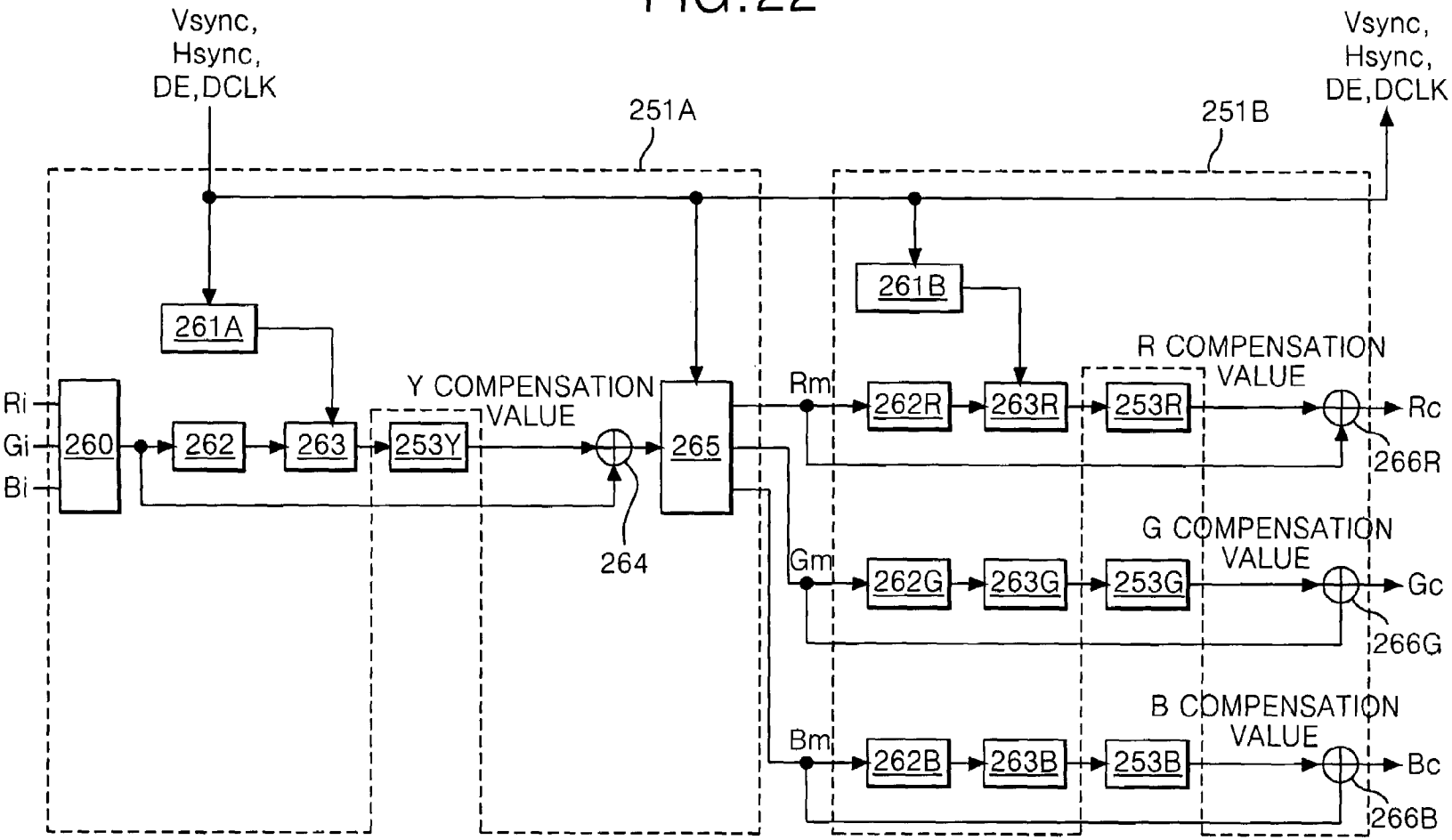
FIG. 22 is a second partial diagram of a compensation circuit.

In FIG. 22, the compensator 251 251 may include a first compensator circuit 251A which modulates the input digital video data Ri/Gi/Bi which are to be supplied to the panel defect location according to location data PD and compensation data CD stored in the non-volatile memory 253 to generate a modulated digital video signal Rm/Gm/Bm. Additionally, the compensator 251 may include a second compensator circuit 251B that modulates the digital video data Rm/Gm/Bm, created by the first compensator circuit 251A, according to the charge characteristic compensation data.

The first compensator circuit 251A can include a first converter 260, a first location analyzer 261A, a first gray level analyzer 262, a first address generator 263, a first operator 264, and a second converter 265.

Non-volatile memory 253Y may store panel defect compensation data for each location and for each gray level. The stored panel defect compensation data may be used to finely modify the brightness information Yi of the input digital video data Ri/Gi/Bi which are to be displayed at the panel defect location. The non-volatile memory 253Y may be EEPROM.

The first converter 260 can calculate the brightness information Yi and the color difference information Ui/Vi which are bit-extended to n/n/n bits according to Mathematical Formulas 1 to 3.

$$Yi=0.299Ri+0.587Gi+0.114Bi \quad \text{[Mathematical Formula 1]}$$

$$Ui=-0.147Ri-0.289Gi+0.436Bi=0.492(Bi-Yi) \quad \text{[Mathematical Formula 2]}$$

$$Vi=0.615Ri-0.515Gi-0.100Bi=0.877(Ri-Yi) \quad \text{[Mathematical Formula 3]}$$

The first location analyzer 261A may judge the display location of the input digital video data Ri/Gi/Bi according to a vertical/horizontal synchronization signal Vsync, Hsync, a data enable signal DE, and a dot clock DCLK. The first gray level analyzer 262 analyzes the gray level of the input digital video data Ri/Gi/Bi on the basis of the brightness information Yi from the first converter 260.

The first address generator 263 can compare the panel defect location data of the non-volatile memory 253Y with an output signal of the first location analyzer 261A. If the display location of the input digital video data Ri/Gi/Bi is judged to correspond to the location within the panel defect area, then the first address generator 263 generates a read address for reading the panel defect compensation data corresponding to the location within the panel defect area stored in the non-volatile memory 253Y.

The panel defect compensation data outputted from the non-volatile memory 253Y is supplied to the first operator 264. The first operator 264 modulates the brightness of the input digital video data Ri/Gi/Bi which are to be displayed at the panel defect location by adding or subtracting the panel defect compensation data from the non-volatile memory 253Y to or from n bit brightness information Yi from the first converter 260. In some compensation circuits, the operator 264 might include a multiplier or divider which multiplies or divides the n bit brightness information Yi by the panel defect compensation data.

The brightness information modulated by the first operator 264 increases or decreases the extended n bit brightness information Yi, thus the brightness of the input digital video data Ri/Gi/Bi can be finely adjusted.

The second converter 265 outputs the first modulation data Rm/Gm/Bm of which the bit number is restored to the m/m/m bits according to Mathematical Formulas 4 to 6, which use the brightness information, Yi, and the color difference information, Ui/Vi, as variables.

$$R=Yi+1.140Vi \quad \text{[Mathematical Formula 4]}$$

$$G=Yi-0.395Ui-0.581Vi \quad \text{[Mathematical Formula 5]}$$

$$B=Yi+2.032Ui \quad \text{[Mathematical Formula 6]}$$

The second compensator circuit 251B can generate the second modulated digital video data Rc/Gc/Bc by increasing or decreasing the first modulated digital video data Rm/Gm/Bm modulated by the first compensator circuit 251A by the charge characteristic compensation data which are stored in non-volatile memories 253R, 253G, and 253B. The second compensator circuit 251B can include a second location analyzer 261B; one or more second gray level analyzers 262R, 262G, and/or 262B;, one or more second address generators 263R, 263G, and 263/or B; and one or more second operators 266R, 266G, and/or 266B.

A red non-volatile memory 253R stores the location data PD and the panel defect compensation data CD of a linked sub-pixel that includes a red sub-pixel. A green non-volatile memory 253G stores the location data PD and the panel defect compensation data CD of a linked sub-pixel that includes a green sub-pixel. A blue non-volatile memory 253B stores the location data PD and the panel defect compensation data CD of a linked sub-pixel that includes a blue sub-pixel. In some comparators 251, the red, green, and blue non-volatile memories, 253R, 253G, and 253B, respectively, may be part of a single non-volatile memory or may be part of a single non-volatile memory having separate storage spaces.

A second location analyzer 261B may judge the display location of the input digital video data Ri/Gi/Bi according to a vertical/horizontal synchronization signal Vsync, Hsync, a data enable signal DE, and a dot clock DCLK. One or more second gray level analyzers 262R, 262G, and 262B may analyze the gray level of the input digital video data Ri/Gi/Bi.

One or more second address generators 263R, 263G, 263B can evaluate the location data of the linked sub-pixel stored in the non-volatile memories 253R, 253G, 253B. If the display location of the input digital video data Ri/Gi/Bi corresponds to the linked sub-pixel, the address generators 263R, 263G, 263B can generate a read address for reading the charge characteristic compensation data corresponding to the linked sub-pixel stored in the non-volatile memories 253R, 253G, 253B. The charge characteristic compensation data outputted from the non-volatile memories 253R, 253G, and/or 253B are supplied to the second operators 266R, 266G, and 266B.

The second operators 266R, 266G, and/or 266B can add or subtract the charge characteristic compensation data from the non-volatile memories 253R, 253G, and/or 253B to or from the output data of the first compensator circuit 251A. In some compensation circuits 251, the second operators 266R, 266G, and/or 266B might include a multiplier and/or divider and use the charge characteristic compensation data to perform a multiplication or division operation.

The data of a non-defective sub-pixel which is not connected to the linked sub-pixel is not modulated in the output data Rc, Gc, Bc of the second compensator circuit 251B. Furthermore, the data of the non-defective sub-pixel which is neither included in the panel defect area nor included in the linked sub-pixel is not modulated by the first and/or second compensator circuits 251A and 251B, and by-passes compensator 251 while maintaining the original data to be inputted to the timing controller 204.

The timing controller 204 can generate a gate control signal ("GDC") for controlling the gate drive circuit 202, and a data control signal ("DDC") for controlling the data drive circuit 201. The GDC and/or the DDC signals can be generated based on a vertical/horizontal synchronization signal Vsync, Hsync, a data enable signal DE, and a dot clock DCLK supplied through the compensation circuit 205. Additionally, the timing controller 204 can supply the corrected digital video data Rc/Gc/Bc to the data drive circuit 201 in accordance with the dot clock DCLK.

The data drive circuit 201 can receive the corrected digital video data Rc/Gc/Bc, convert the digital video data Rc/Gc/Bc into the analog gamma compensation voltage (data voltage), and supplies the analog gamma compensation voltage as the data voltage to the data lines 206 of the liquid crystal display panel 203 under control of the timing controller 204. The gate drive circuit 202 can sequentially supply a scan signal to the gate lines 208, thereby turning on the TFT's connected to the gate lines 208 to select the liquid crystal cells Clc of one horizontal line to which the analog gamma compensation voltage is to be supplied. The analog data voltage generated from the data drive circuit 201 may be synchronized with the scan pulse to be supplied to the liquid crystal cells Clc of the selected horizontal line.

The processes and/or methods explained, as well as other processes and methods may also be applied to other non liquid crystal display devices. These other devices may include an active matrix organic light emitting diode OLED and other flat panel display devices.

As described above, the flat panel display device, the picture quality controlling method and apparatus according to the present invention improves the picture quality of the flat panel display device by the data modulation using the repair process and the compensation circuit, thus it is possible to reduce the degree of perception felt by the bare eye for the defect pixel and it is possible to compensate the panel defect caused by the data modulation. Further, the flat panel display device, and the picture quality controlling method and apparatus according to the present invention converts the RGB video data which are to be displayed in the panel defect location to the brightness component and the color difference component by paying attention to the fact that the human eye is more sensitive to the brightness difference than the color difference in compensating the panel defect, and controls the brightness of the panel defect location by extending the number of bits of the Y data which include the brightness information, thus it is possible to finely adjust the brightness in the panel defect location of the flat panel display device.

While various embodiments of the invention have been described, it will be apparent to those of ordinary skill in the art that many more embodiments and implementations are possible within the scope of the invention. Accordingly, the invention is not to be restricted except in light of the attached claims and their equivalent.

What is claimed is:

1. A picture quality controlling method of a flat panel display device including a display panel having a link pixel including a defective pixel and an adjacent non-defective pixel, that is electrically connected to the defective pixel, comprising:

determining a panel defect location data which indicates the location of a panel defective area having a brightness difference in comparison with a non-defective area;

determining a panel defect compensation data to compensate the brightness of the panel defect location;

determining a charge characteristic compensation data to compensating a charge characteristic of the link pixel;

determining a link pixel location data which indicates the location of the link pixel;

storing the panel defect location data, the panel defect compensation data, the charge characteristic compensation data, and the link pixel location data in a memory of the flat panel display device;

converting a video signal of the panel defective area into a brightness information and a color difference information;

modulating the brightness information of the panel defective area by increasing or decreasing the brightness information according to the panel defect compensation data;

converting the color difference information and the modulated brightness information into a modulated video signal;

generating a compensated video signal by increasing or decreasing the modulated video signal according to the charge characteristic compensation data of the link pixel.

2. The picture quality controlling method according to claim 1, further comprising the steps of:

inspecting the panel defect by applying the modulated video signal to the display panel; and determining a final compensation data and a final location data of the panel defect, as a result of the inspection.

3. The picture quality controlling method according to claim 2, where the final location data includes a bright line generated because of non uniformity of a brightness of a backlight, and the final compensation data includes compensation data for the bright line.

4. The picture quality controlling method according to claim 1, further comprising the steps of:

inspecting the defective pixel by applying the compensated video signal to the display panel; and determining a final compensation data and a final location data of the defective pixel as a result of the inspection.

5. The picture quality controlling method according to claim 1, where a non-defective pixel adjacent to the defective pixel is a pixel of the same color as the defective pixel.

6. The picture quality controlling method according to claim 1, where the panel defect compensation data is determined based on a gray level value of data and a location of the panel defect area.

7. The picture quality controlling method according to claim 1, where the charge characteristic compensation data is determined based on a gray level value of data and a location of the link pixel.

8. The picture quality controlling method according to claim 1, where the memory comprises a non volatile memory.

9. The picture quality controlling method according to claim 8, where the non volatile memory comprises EEPROM or EDID ROM.

10. A picture quality controlling apparatus of a flat panel display device having a display panel having a link pixel including a defective pixel and an adjacent non-defective pixel, that is electrically connected to the defective pixel, comprising:

a memory which stores a charge characteristic compensation data that compensates a charge characteristic for the link pixel, a link pixel location data that indicates a location of the link pixel, a panel defect compensation data that compensates a brightness of a panel defect area, and a panel defect location data which indicates a location of a panel defect area;

a first compensator that converts a video signal of the panel defective area into a brightness information and a color difference information, modulates the brightness information of the panel defective area by increasing or decreasing the brightness information of the panel defective area according to the panel defect compensation data stored at the memory, and converts the color difference information and the modulated brightness information into a modulated video signal; and a second compensator that generates a compensated video signal by increasing or decreasing the modulated video signal from the first compensator according to the charge characteristic compensation data of the link pixel stored at the memory.

11. The picture quality controlling apparatus according to claim 10, wherein the first compensator converts red, green and blue video signals of the panel defective area into the brightness information and the color difference information, and converts the color difference information and the modulated brightness information into a red, green, blue modulated video signals.

12. The picture quality controlling apparatus according to claim 10, where a non-defective pixel adjacent to the defective pixel is a pixel of the same color as the defective pixel.

13. The picture quality controlling apparatus according to claim 10, where the panel defect compensation data is determined based on a gray level value of data and a location of the panel defect area.

14. The picture quality controlling apparatus according to claim 10, where the charge characteristic compensation data is determined based on a gray level value of data and a location of the link pixel.

15. The picture quality controlling apparatus according to claim 10, where the memory comprises a non volatile memory.

16. The picture quality controlling apparatus according to claim 15, where the non volatile memory comprises EEPROM or EDID ROM.

* * * * *